US008381709B2

(12) United States Patent
Woessner et al.

(10) Patent No.: US 8,381,709 B2
(45) Date of Patent: Feb. 26, 2013

(54) ARM PITCHING MACHINE HAVING A LEAD TIMING ARM

(75) Inventors: William R. Woessner, Chicago, IL (US); David B. Andrews, Carson City, NV (US); Timothy D. Greene, Reno, NV (US); Jose L. Lopez, Reno, NV (US)

(73) Assignee: Wilson Sporting Goods Co., Chicago, IL (US)

( * ) Notice: Subject to any disclaimer, the term of this patent is extended or adjusted under 35 U.S.C. 154(b) by 239 days.

(21) Appl. No.: 13/037,443

(22) Filed: Mar. 1, 2011

(65) Prior Publication Data

US 2011/0214651 A1 Sep. 8, 2011

Related U.S. Application Data

(60) Provisional application No. 61/311,486, filed on Mar. 8, 2010.

(51) Int. Cl.
*F41B 3/04* (2006.01)

(52) U.S. Cl. ..... 124/7; 124/16; 124/36; 473/422; 473/451; 473/459; 473/415

(58) Field of Classification Search ..... 473/422, 473/451, 459, 474, FOR. 103, FOR. 115, 473/415, 431, 453; 124/6, 7, 8, 16, 78, 21, 124/36, 41.1, 17, 56, 61, 79; 119/702, 707; 273/317, 317.6–317.9
See application file for complete search history.

(56) References Cited

U.S. PATENT DOCUMENTS 3,136,308 A * 6/1964 Giovagnoli ..... 124/7
3,207,147 A * 9/1965 Giovagnoli ..... 124/49
3,252,453 A * 5/1966 Giovagnoli ..... 124/7
3,659,576 A * 5/1972 Eade et al. ..... 124/7
3,777,733 A * 12/1973 Mitchell ..... 124/7
4,195,614 A 4/1980 Ponza ..... 124/1
4,524,749 A * 6/1985 Giovagnoli ..... 124/7
4,632,088 A 12/1986 Bruce ..... 124/78
4,676,504 A 6/1987 Ponza ..... 124/7
4,699,377 A * 10/1987 Ponza ..... 473/429
4,823,763 A 4/1989 Ponza ..... 124/78
4,844,458 A 7/1989 Gatchel et al. ..... 273/30
4,854,588 A 8/1989 Gatchel et al. ..... 273/30
4,890,834 A * 1/1990 Ponza ..... 473/421
5,121,735 A * 6/1992 Hancock ..... 124/7
5,607,151 A 3/1997 Daley ..... 124/78
5,832,909 A 11/1998 Grant et al. ..... 124/6
5,865,161 A 2/1999 Bruce ..... 124/78
6,093,117 A 7/2000 Sherlock et al. ..... 473/422
6,190,271 B1 2/2001 Rappaport et al. ..... 473/451
6,202,636 B1 3/2001 O'Brien ..... 124/71
6,237,583 B1 5/2001 Ripley et al. ..... 124/78
6,276,353 B1 8/2001 Briggs et al. ..... 124/71
(Continued)

*Primary Examiner* — Gene Kim
*Assistant Examiner* — John E Simms, Jr.
(74) *Attorney, Agent, or Firm* — Terence P. O'Brien

(57) ABSTRACT

A pitching machine for pitching a ball to a batter positioned in a first batting location. The pitching machine including a frame, a drive assembly coupled to the frame, a pitching arm and a lead timing arm. The pitching arm is coupled to drive assembly and rotatable in a first direction about a first axis. The pitching arm includes a forward side configured to contact and project the ball during a portion of the rotation of the pitching arm about the first axis. The pitching arm is configured to project the ball at least a first ball release position with respect to the first axis. The lead timing arm includes a marker. The lead timing arm is coupled to the pitching arm such that the marker is visible to the batter positioned in the first batting location prior to the pitching arm reaching the first ball release position.

20 Claims, 19 Drawing Sheets

U.S. PATENT DOCUMENTS

| | | | | |
|---|---|---|---|---|
| 6,401,704 | B1 | 6/2002 | Caldwell | 124/78 |
| 6,427,675 | B1 | 8/2002 | Caldwell et al. | 124/78 |
| 6,440,013 | B1 | 8/2002 | Brown | 473/422 |
| 6,443,859 | B1 * | 9/2002 | Markin | 473/451 |
| 6,505,617 | B1 | 1/2003 | Neuman | 124/7 |
| 6,546,924 | B2 * | 4/2003 | Battersby et al. | 124/78 |
| 6,637,422 | B2 | 10/2003 | Wojtkiewicz et al. | 124/78 |
| 6,672,297 | B1 | 1/2004 | Liao | 124/6 |
| 6,715,478 | B1 * | 4/2004 | Tanner | 124/16 |
| 6,732,724 | B1 | 5/2004 | Paulson et al. | 124/6 |
| 6,739,325 | B1 | 5/2004 | Paulson | 124/78 |
| 7,806,788 | B1 * | 10/2010 | Neuman | 473/451 |

* cited by examiner

ARM PITCHING MACHINE HAVING A LEAD TIMING ARM

RELATED U.S. APPLICATION DATA

The present invention claims the benefit of the filing date under 35 U.S.C. §119(e) of U.S. Provisional Patent Application Ser. No. 61/311,486, filed on Mar. 8, 2010, which is hereby incorporated by reference in its entirety. The present application is related to co-pending U.S. patent application Ser. No. 13/037,454 filed on the same day herewith by William R. Woessner, David B. Andrews, Timothy D. Greene and Jose L. Lopez entitled ARM PITCHING MACHINE HAVING IMPROVED BALL DELIVERY ASSEMBLY AND PITCHING ARM, the full disclosure of which is hereby incorporated by reference.

FIELD OF THE INVENTION

The present invention relates to an arm pitching machine.

BACKGROUND OF THE INVENTION

Pitching machines are widely used by both professional and non-professional athletes for batting practice. Conventional pitching machines typically fall into two categories disc or wheel driven machines or arm pitching machines. Disc or wheel driven machines are more prevalent and include a pitching head having either one motor driven wheel or two counter-rotating motor driven wheels that engage a ball and project the ball toward an awaiting batter. Arm driven machines typically use an elongate arm that rotates about a pivot axis. The arm is typically spring loaded and includes a mechanism for allowing the stored energy in the spring to rapidly rotate the arm at a particular point in the rotation of the arm, typically soon after the pitching arm acquires a ball.

Arm pitching machines are preferred by many players because the arm release motion is closer to an actual pitch thrown by a pitcher than a ball being propelled from a disc or wheel driven machine. Arm pitching machines are often configured to hold a large number of balls, or attach to a feed tray with a large number of balls. The arm pitching machines typically rotate about an axis and acquire a ball from a ball retrieval location or assembly. Typically, after a few degrees of continued rotation about the axis at typically a fairly constant speed, the spring energy is released and the arm is driven quickly about the pivot axis resulting in the pitching of the ball from the pitching machine toward a batter. This pitch cycle is then typically repeated at some time interval for a next ball, and additional balls thereafter.

However, arm pitching machines do have some drawbacks. For example, during a baseball game, most batters typically load or prepare for the pitched ball during the pitcher's windup and then are prepared to execute their swing efficiently and effectively. If a batter does not have time to load or prepare, the batter can be caught off guard, off balance or in an inefficient batting position and thereby have a decreased chance of making solid contact with the ball and maximizing the potential of his or her swing. If a batter loads too early (such as before a pitcher begins his or her windup), the batter can lose focus, become distracted or even experience some level of fatigue. Accordingly, batters when working with pitching machines, and especially arm pitching machines, will attempt to prepare for the pitch by adapting to the time interval of the pitch cycle of the pitching machine. This practice is difficult to perfect, and can be tedious or even frustrating to batters. Many batters prepare or load too early or too late, and some machines have some variability in the interval of the pitch cycle which further increases the difficulty of properly timing the next pitch from a pitching machine. When a batter does not accurately adjust to the interval of the pitching machines pitch cycle, the batter's effectiveness decreases because he or she can find himself or herself preparing too early or too late for the pitch, or having both occur in the same practice session.

Indeed the entire purpose of using a pitching machine (for example, to improve the batter's swing and/or hitting ability) can be negated by a batter's inability to properly time the pitch cycle of a particular pitching machine. Therefore, what is needed is a pitching machine that can provide an easy, effective and repeatable way of providing an indication of when the pitch is about to leave the pitching machine. It would be advantageous to have an arm pitching machine that can provide a signal to the batter that could simulate the approximate time frame of a pitcher's windup. It would be beneficial to provide such a feature in a cost effective, reliable and easy to recognize manner. What is needed is a pitching machine that can allow a batter to readily time the pitched ball from the pitching machine.

Arm pitching machines have other drawbacks. The pitching arm of arm pitching machines typically include some structure for receiving the ball before the spring energy or other pitch generating force is applied to the pitching arm to pitch the ball toward the batter. These structures are typically referred to as throwing hands and can take many forms, and can be critical to producing an accurate pitch. Accuracy is a critical characteristic of a pitching machine. Batters often want to focus on hitting a ball in a particular location or portion of the strike zone. Batters also typically want to know that the pitch coming from the pitching machine will be a strike, and/or will be in the location they intend. Some existing throwing hands are constructed with a continuous or sharp curve along their longitudinal or major dimension. Such curved shapes can induce an undesirable back spin on the ball that can change the trajectory of the ball causing it to drift upward away from the intended target. Other throwing hands are constructed such that minimal contact exists between the ball and the throwing hand. For example, a throwing hand constructed with a pair of projecting ridges upon which the ball rests before being thrown results in the ball contacting the throwing hand along essentially two lines of contact. Such limited contact reduces the accuracy and control of the pitched ball.

Accordingly, there is a need for a throwing hand design of a pitching arm of an arm pitching machine that provides improved contact with the ball and maximizes the accuracy of the pitched ball. What is needed is a pitching arm and throwing hand construction that provides repeatable accurate pitches in the location desired by the batter or person (coach or manager) operating the pitching machine.

Further, arm pitching machines typically are configured to pitch one ball at a time from a feed tube or hopper containing numerous balls. Typically, the balls are gravity fed through a feed tube to the location where the throwing hand picks up the lowest ball. As a result, the group of balls is aligned in the tube with one ball contacting or bearing against the ball below it. This continues all the way to the lowest ball, which is typically the ball that is retrieved or picked up by the pitching arm. The weight of the balls above the lowest ball applies a force against, or side load to, the lowest ball that can cause the lowest ball to fall from the throwing hand of the pitching arm or move in an undesirable manner on the pitching arm before the pitching arm propels the ball out of the machine. This side load can reduce the repeatability and reliability of the pitching machine and can require an operator to stop the pitching machine to retrieve those balls that fall from the throwing hand. The side load can also negatively affect the accuracy of the pitched ball because the side load causes the lowest ball to shift or otherwise in an undesirable manner as it is picked up. This shifting or movement of the ball can inhibit the smooth pitching of the ball from the machine and therefore the accuracy of the pitched ball.

Accordingly, there is a need for an arm pitching machine capable of pitching multiple balls one at a time to have a feed system that eliminates the side load or force on the lowest ball from the group of balls next in line for pitching.

SUMMARY OF THE INVENTION

The present invention provides a pitching machine configured for pitching a ball to a batter positioned in a first batting location. The pitching machine includes a frame, a drive assembly coupled to the frame, a pitching arm and a lead timing arm. The pitching arm is coupled to drive assembly and rotatable in a first direction about a first axis. The pitching arm includes a forward side configured to contact and project the ball during a portion of the rotation of the pitching arm about the first axis. The pitching arm is configured to project the ball at least a first ball release position with respect to the first axis. The lead timing arm includes a marker. The lead timing arm is coupled to the pitching arm such that the marker is visible to the batter positioned in the first batting location prior to the pitching arm reaching the first ball release position.

According to a principal aspect of a preferred form of the invention, a pitching machine for pitching a ball includes a frame, a drive assembly coupled to the frame, a pitching arm coupled to the drive assembly, and a lead timing arm. The pitching arm includes a throwing hand having a first distal end. The pitching arm is rotatable in a first direction about a pivot axis. The radial distance from the pivot axis to the first distal end defines a first line segment. The lead timing arm includes a marker and has a second distal end. The lead timing arm is coupled to the pitching arm and is configured to move with the pitching arm. The radial distance from the pivot axis to the second distal end defines a second line segment. The first and second line segments define a lead angle, which is within the range of 10 to 120 degrees.

According to another principal aspect of a preferred form of the invention, a pitching machine for pitching a ball to a batter includes a frame, a pitching arm coupled to the frame, and a throwing hand coupled to a distal end of the pitching arm. The pitching arm is rotatable in a first direction about a first axis. The throwing hand includes an elongate body and has a ball contact region. The ball contact region defines a portion of a cylinder wherein the curvature of the ball contact region defines a radius that is equal to or greater than the radius of the ball, and the length of ball contact region is at least twice as long as the diameter of the ball.

According to another principal aspect of a preferred form of the invention, a pitching machine for pitching a plurality of balls one at a time to a batter includes a frame, a ball feed trough coupled to the frame, a ball acquisition structure coupled to the frame, and a ball cup coupled to the frame. The ball feed trough has a lower end and is configured to retain at least three of the balls. The ball acquisition structure is spaced apart from, and is configured to support one of the balls at an elevation below, the lower end of the feed trough. The ball cup is positioned at the lower end of the ball feed trough and is adjacent the ball acquisition structure. The ball trough is sloped to allow for gravity feed of the balls to the ball cup. The ball cup is sized for retaining one of the balls. The ball cup has a curved wall defining a ball opening sized for receiving and dispensing the one of the balls. The ball cup is rotatable about a ball cup axis such that, during use, the ball cup receives one of the balls when the ball opening of the ball cup rotates to meet the lowest ball in the ball trough. As the ball cup rotates, the curved wall inhibits more than one ball from entering the ball cup, and as the ball cup continues to rotate, the ball opening opens toward the ball acquisition structure enabling the ball to exit the ball cup and drop to the ball acquisition structure.

This invention will become more fully understood from the following detailed description, taken in conjunction with the accompanying drawings described herein below, and wherein like reference numerals refer to like parts.

DETAILED DESCRIPTION OF THE INVENTION

Figure 1:
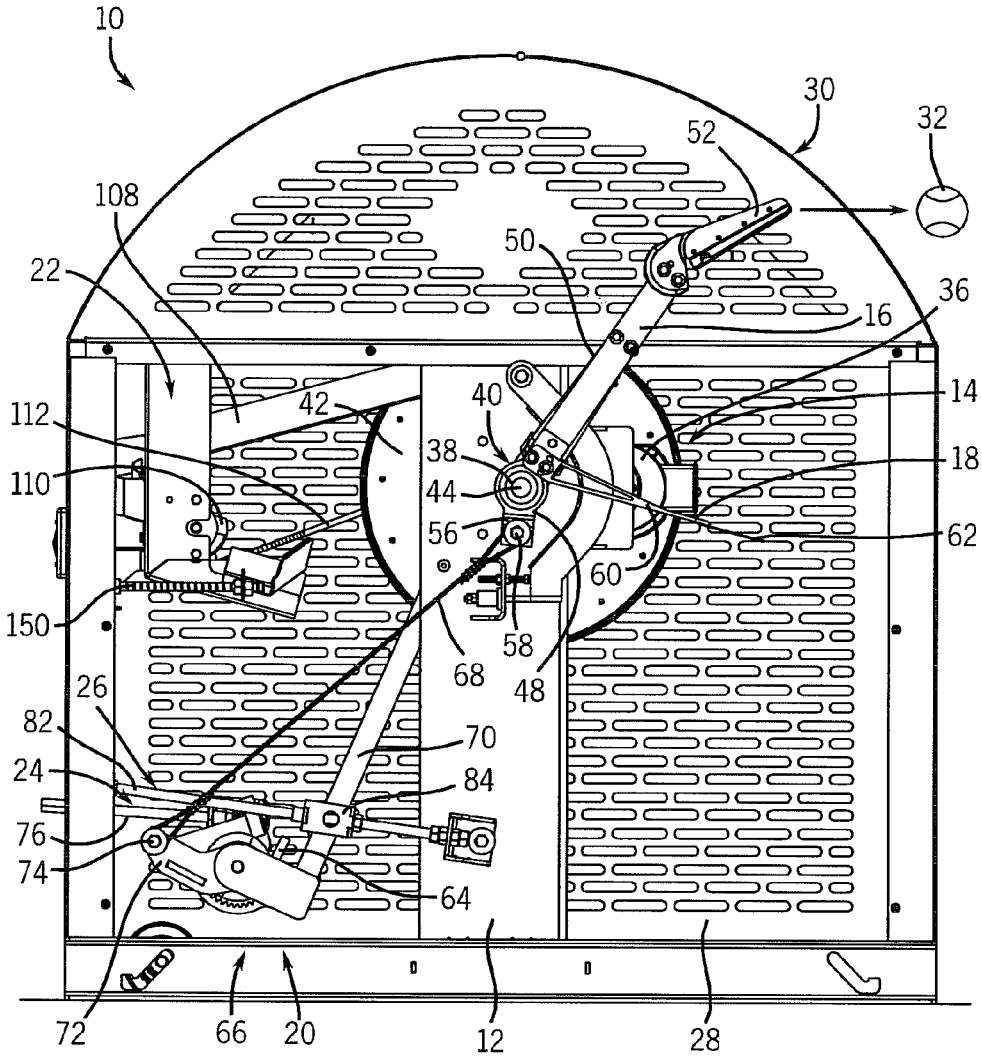
FIG. 1 is a side view of an arm pitching machine with a portion of the housing removed and the pitching arm in a first position in accordance with a preferred embodiment of the present invention.
Figure 2:
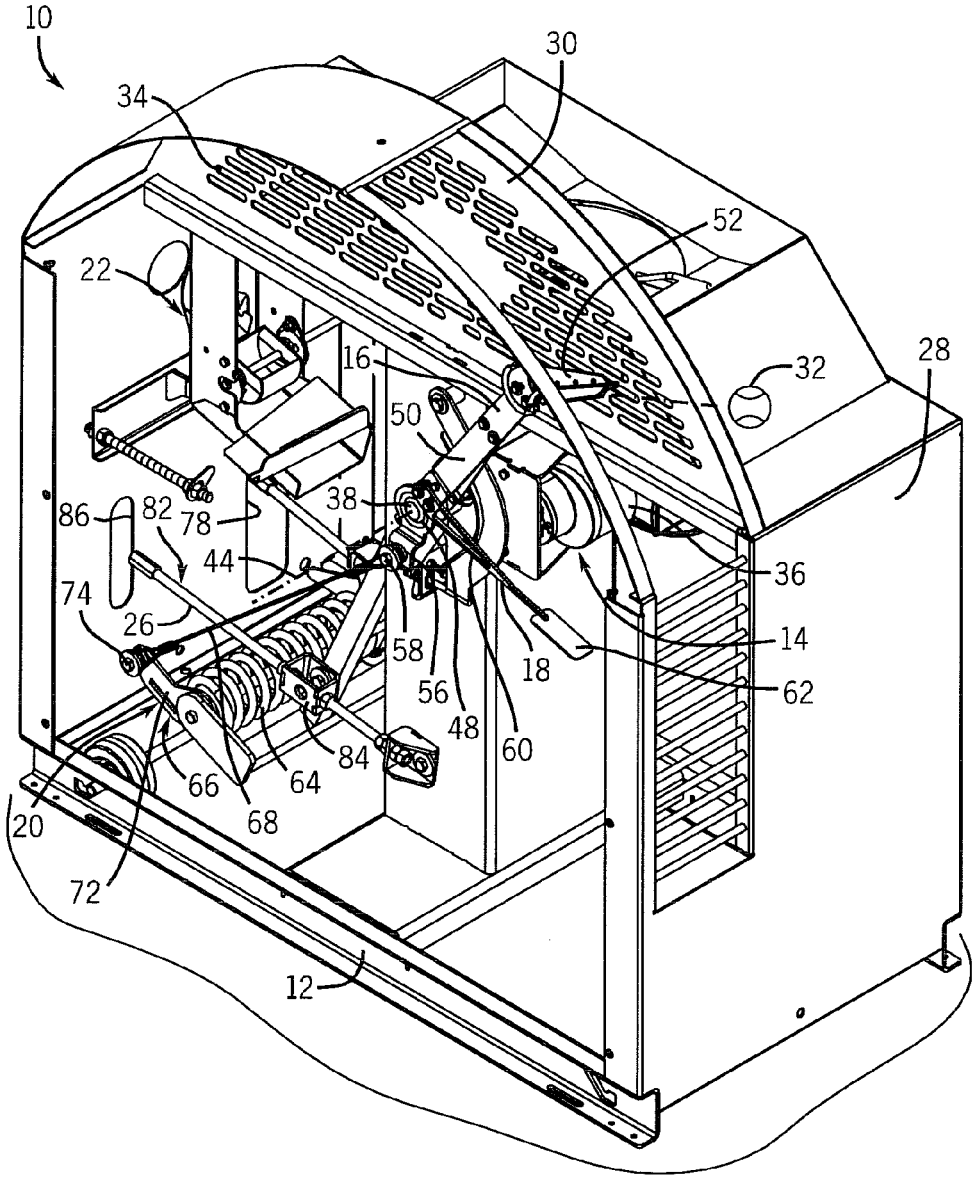
FIG. 2 is front, side perspective view of the arm pitching machine of FIG. 1.
Figure 3:
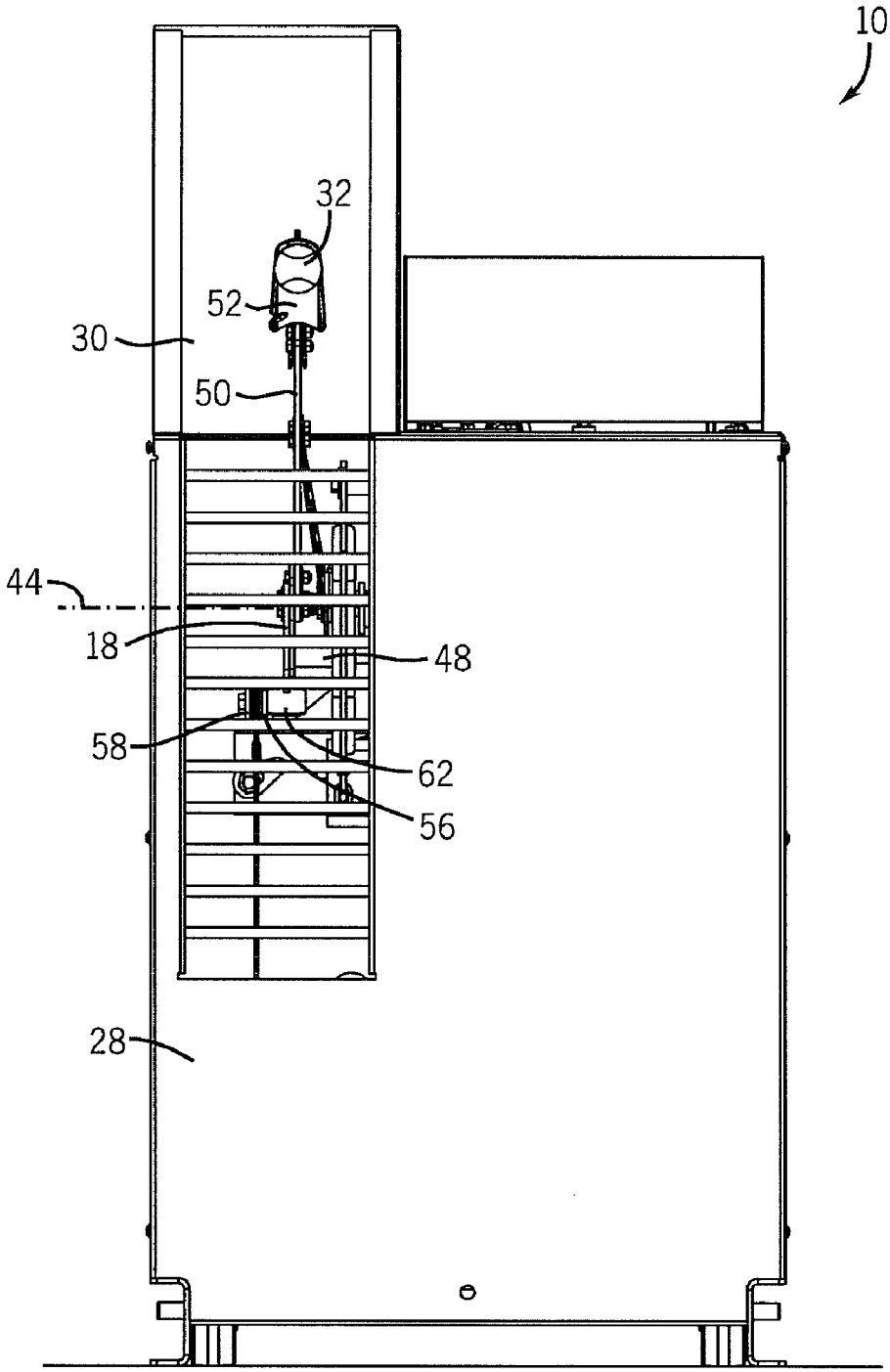
FIG. 3 is a front view of the arm pitching machine of FIG. 1.

Referring to FIGS. 1 through 3, an arm pitching machine configured for projecting or pitching a ball is indicated generally at 10. The present invention is described below with respect to a pitched baseball or softball. The present invention is also applicable to the projecting of baseballs or softballs for other purposes, such as to replicate a fly ball, a line drive or a ground ball. Further, the present invention is also applicable to other types of balls, such as, for example, footballs, tennis balls, soccer balls, and volleyballs.

The pitching machine 10 includes a frame 12, a drive assembly 14, a pitching arm 16, a lead timing arm 18, a biasing assembly 20, a ball feed system 22, a speed adjustment mechanism 24 and a pitch height adjustment mechanism 26. The frame 12 is a support structure for supporting the components, assemblies and systems of the pitching machine. The frame 12 is configured to support the pitching machine 10 on a substantially horizontal surface during use. The frame 12 is also configured to support the pitching machine 10 a slightly angled or sloped surface such as a baseball field or pitching mound. The frame 12 is formed of a high strength durable material, preferably a steel. In alternative embodiments, the frame can be formed of other materials, such as, for example, other alloys, a fiber composite material or combinations thereof. A multi-piece housing 28 is removably attached to the frame 12. The housing 28 is preferably formed of a rigid material, such as steel. In alternative embodiments, the housing can be formed of other materials, such as, for example, a plastic, other allows, a fiber composite material, a resin or combinations thereof. The housing 28 includes a ball delivery window 30 which is advantageously sized to enable a batter or other user of the machine to see the lead timing arm 18, the pitching arm 16 and the baseball 32 as the baseball 32 is delivered or pitched from the pitching machine 10. The housing 28 further includes a plurality of openings 34 to provide some visibility of the internal components of the pitching machines, but are sized to inhibit a person or child from being able to contact the operating components of the pitching machine 10 during use. The openings 34 also allow for air flow through the pitching machine 10.

Figure 4:
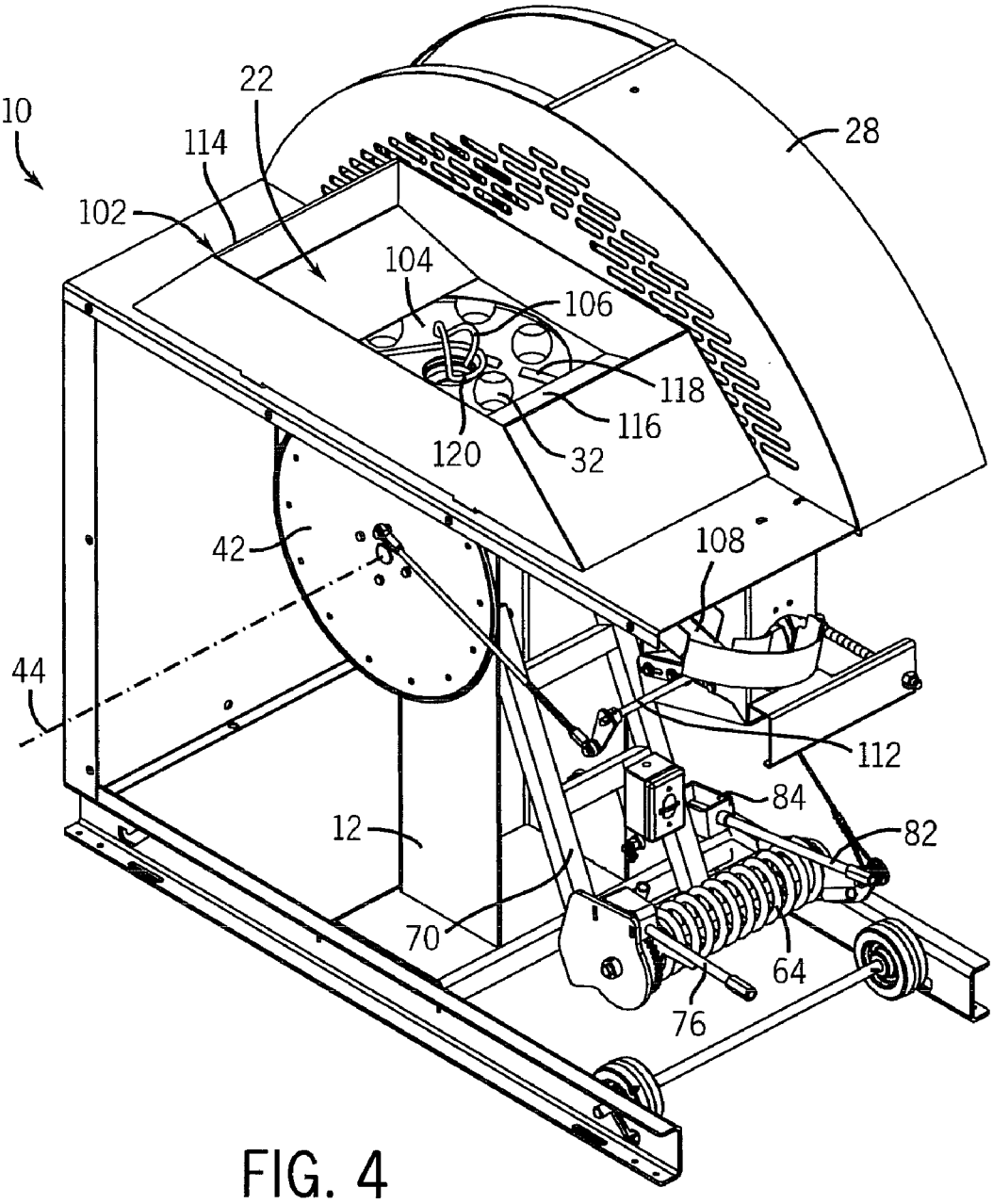
FIG. 4 is top, rear perspective view of the pitching machine of FIG. 1 with a portion of the housing removed.
Figure 5:
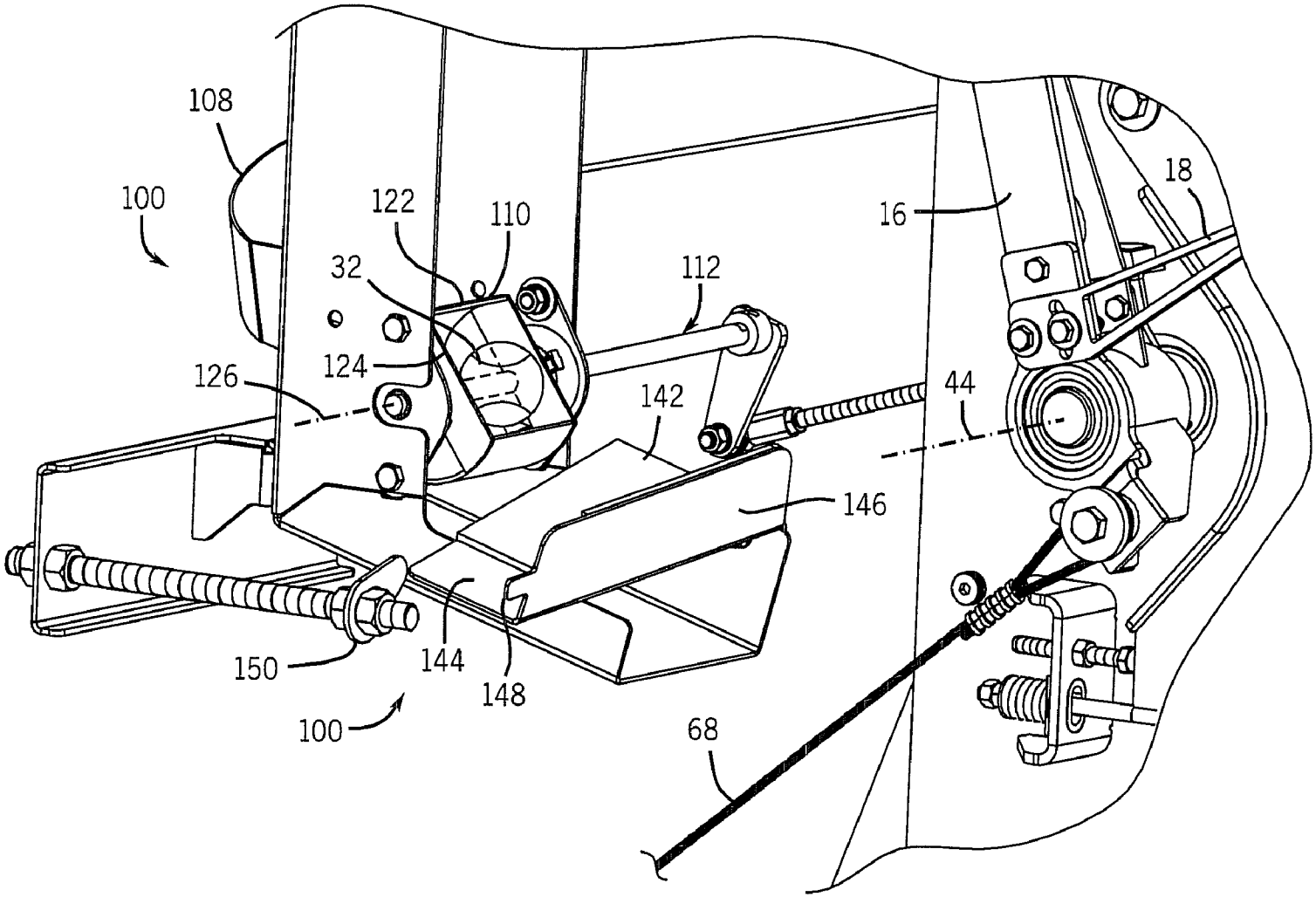
FIG. 5 is top, side perspective view of a ball acquisition structure of the arm pitching machine of FIG. 1.
Figure 6:
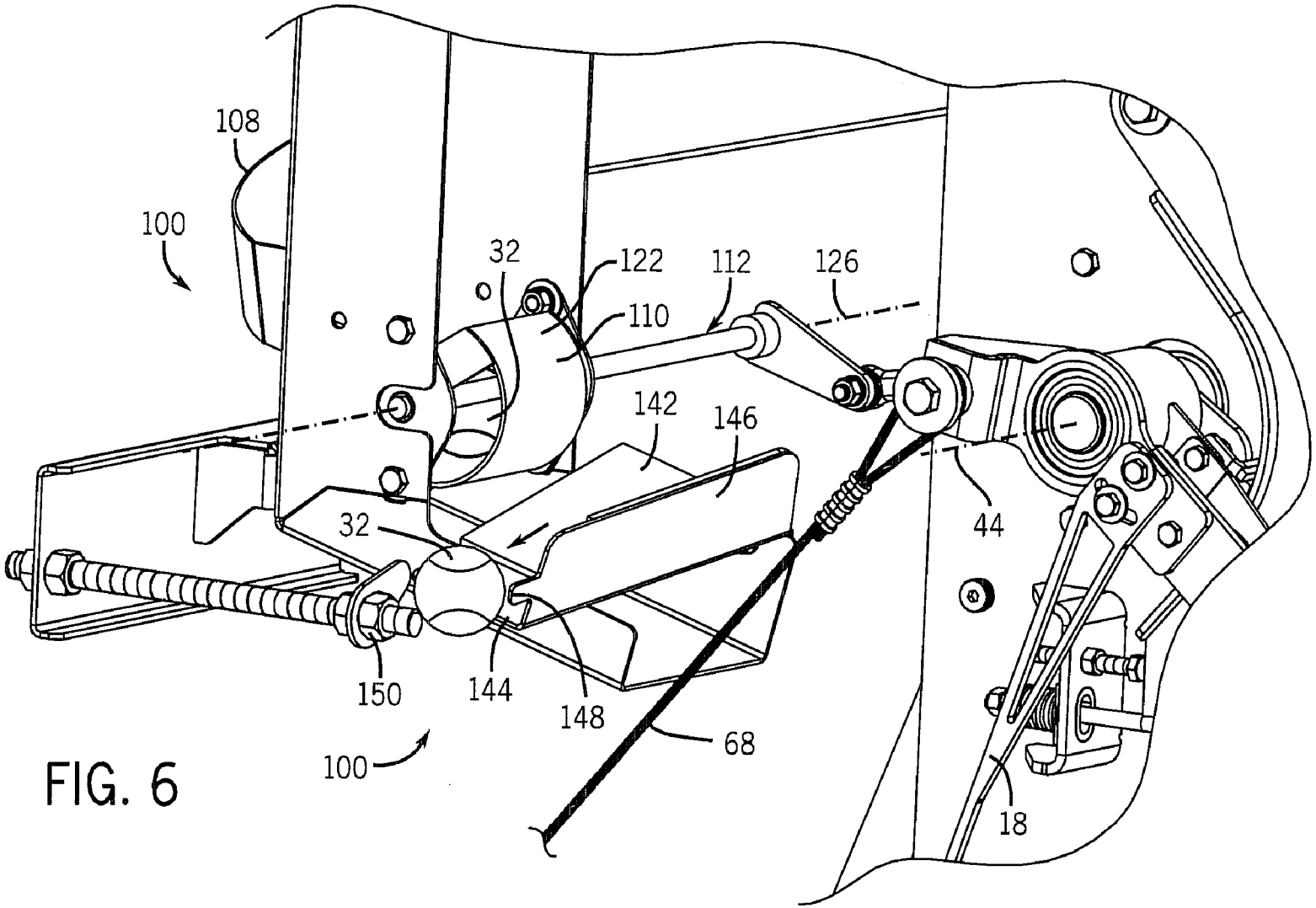
FIG. 6 is top, side perspective view of a ball acquisition structure of the arm pitching machine of FIG. 1.

The drive assembly 14 is connected to and supported by the frame 12 and operably coupled to the ball feed system 22, the pitching arm 16 and the biasing assembly 20. The drive assembly 14 includes a drive motor 36, a drive shaft 38, a drive collar 40 and a drive wheel 42 (FIG. 4). The drive assembly 14 provides a continuous rotational movement of the drive shaft 38 for rotating the pitching arm 16 through a portion of its pitch cycle and for continuously operating the ball feed system 22. For purposes of this invention, the term pitch cycle refers to a single cycle or 360 degree rotation of the pitching arm 16 about a first pivot axis 44. The pitching machine 10 is configured to pitch a single baseball during a single pitch cycle. The drive motor 36 converts electrical energy into mechanical rotational energy. The drive motor 36 is preferably an AC motor having a horsepower rating of and receives power from an off-machine AC power source. The off-machine AC power source can be a stand-alone generator or power supplied from a community electrical grid. In an alternative preferred embodiment, the drive motor 36 can be a DC battery powered motor. The drive motor 36 drives or rotates the drive shaft 38. In a preferred embodiment, the drive motor 36 rotates the drive shaft 38 at a constant speed of approximately 8 rpm. In alternative preferred embodiments, the drive motor can be configured to provide to drive the drive shaft at other speeds or at variable speeds.

The drive shaft 38 is connected to the drive motor 36 and operably coupled to the pitching arm 16 and the drive wheel 42 (FIG. 4), and directly coupled to the drive collar 40. The drive shaft 38 defines the first pivot axis 44 about which the pitching arm 16, the drive collar 40 and the drive wheel 42 rotate. The drive shaft 38 is preferably formed of a high strength, durable material, preferably a steel. Alternatively, the drive shaft 38 can be formed of other materials, such as, for example, other alloys, a ceramic, a fiber composite material, a plastic and combinations thereof. The drive collar 40 receives and is attached to the drive shaft 38 such that the drive collar 40 rotates with the drive shaft 38. The drive collar 40 includes a drive pin (not shown) that is preferably positioned in an offset relationship to the drive shaft 38. The drive pin bears against and drives (and is positioned directly adjacent to) an arm base unit 48 of the pitching arm 16 through a portion of the pitch cycle of the pitching machine 10.

The pitching arm 16 is an elongate member rotatably coupled to the drive shaft 38. The pitching arm 16 is configured to rotate 360 degrees about the first pivot axis 44. The pitching arm 16 includes the arm base unit 48, an arm link 50 and a throwing hand 52. The arm base unit 48 is operably coupled to the drive collar 40, the drive shaft 38, the lead timing arm 18 and the biasing assembly 20. The arm base unit 48 includes a cylindrical passage that is collinear and receives the drive shaft 38 and a portion of the drive collar 40. The arm base unit 48 is rotatably coupled to the drive shaft 38 and the drive collar 40 through a bearing assembly 54. The arm base unit 48 is rotatable about the pivot axis 44 independent of the drive shaft 38. The base unit 48 further includes a drive surface for contacting the drive pin of the drive collar 40 during a portion of the pitch cycle and a bracket 56 outwardly extending from the pivot axis 44. When the drive pin of the drive collar 40 bears against the drive surface of the base unit 48, the arm base unit 48 rotates about the pivot axis 44 at the same speed as the drive collar 40. The bracket 56 includes a first connection point 58 for connecting the arm base unit 48 to the biasing assembly 20. The first connection point 58 is offset from the pivot axis 44 and radially spaced from the arm link 50 of the pitching arm 16. At the point of the pitch cycle where the biasing assembly 20 reaches an "over the center" position with respect to the pivot axis 44, the biasing assembly 20 is configured to release its energy and rapidly rotate the arm base unit 48 from the first connection point 58 about the pivot axis 44. This rapid rotation upon release of the energy of the biasing assembly 20 causes the pitching arm 16 to pitch the baseball 32.

The arm link 50 is an elongate member connecting the arm base unit 48 to the throwing hand 52. The arm link 50 extends the throwing hand 52 away from the pivot axis 44 increasing the mechanical advantage of the pitching arm 16. The arm base unit 48 and the arm link 50 are preferably formed of high strength, rigid material, preferably steel. In alternative embodiments, the base unit 48 and the arm link 50 are formed of other materials, such as, for example, other alloys, a fiber composite material, a plastic and combinations thereof.

The throwing hand 52 is coupled to the arm link 50. In one preferred embodiment, the throwing hand 52 is fastened to the arm link 50 through conventional fasteners. Alternatively, the throwing hand 52 can be connected to the arm link 50 through other conventional means. In another preferred embodiment, one or more of the arm base unit, the arm link and the throwing hand can be formed as a single integral piece or as two pieces. The throwing hand 52 is configured for picking up and receiving the baseball 32 and then pitching or projecting the baseball 32 at the pitching arm 16 goes through its pitch cycle.

The lead timing arm 18 is an elongate member coupled to the pitching arm 16. The lead timing arm 18 is configured to move in tandem or with the pitching arm 16. In one preferred embodiment, the lead timing arm 18 can include a support link 60 and a marker 62. The support link 60 couples the marker 62 to the pitching arm 16. The support link 60 is preferably formed a rigid resilient material, such as aluminum Alternatively, the support link 60 can be formed of other metals, other alloys, a fiber composite material, a plastic, wood and combinations thereof. The marker 62 preferably includes a generally planar front surface. The marker 62 can be formed of a metal, wood, a fiber composite material, an elastomeric material, a thermoset material, paper, and combinations thereof.

The biasing assembly 20 is configured to adjustably store or load energy as the pitching arm 16 travels through a first portion of the pitch cycle, and then release its stored energy to the pitching arm 16 at the appropriate point in the pitch cycle. The biasing assembly 20 preferably includes a spring 64, such as a coil spring. In other preferred embodiments, the spring 64 can be replaced with another biasing member or spring type, such as, for example, a leaf spring. The spring 64 is mounted to a carriage assembly 66 and operably coupled to the speed adjustment mechanism 24 and to the arm base unit 48 of the pitching arm 16 through the cable 68.

The carriage assembly 66 includes a carriage frame 70 and a mounting bracket 72. The carriage frame 70 supports the spring 64 and is preferably pivotally supported to the frame 12 and coupled to the height adjustment mechanism 26. In an alternative preferred embodiment, the carriage frame can be fixedly coupled to the frame. The carriage frame 70 is formed of a high strength durable material, such as steel. In alternative embodiments, other materials can be used such as, for example, other alloys, a fiber composite material or combinations thereof.

The mounting bracket 72 is coupled to the spring 64 and has a second connection point 74 for the pivotal connection of the cable 68. During an initial portion of the pitch cycle, as the drive assembly 14 rotates the pitching arm 16 about the pivot axis 44. The arm base unit 48 rotates causing the mounting bracket 72 to load the spring 64 through the first and second connection points 58 and 74 and the cable 68. As the pitching arm 16 continues to rotate in a clockwise direction from the vantage point of FIG. 1, the first and second connection points 58 and 74 become aligned with the pivot axis 44 and define a straight line. As the pitching arm continues to rotate, the first connection point 58 of the arm base unit 48 moves out of alignment with the pivot axis 44 and the second connection point 74 and reaches the "over the top" position. At the over the top position, the spring 64 is unrestrained and unloads its stored energy. As the spring 64 unloads it accelerates the first connection point 58 of the arm base unit 48 about the pivot axis 44. This very rapid acceleration occurring at the release or unloading of the spring 64 creates the pitch of the pitching arm 16.

The speed adjustment mechanism 24 is coupled to the opposite end of the spring 64 and includes a shaft 76 and a gear assembly for adjusting the pre-load of the spring 64. The shaft 76 extends from the gear assembly to the rear side of the pitching machine 10 through the aperture 78 for adjustment by the operator of the pitching machine. In one preferred embodiment, the gear assembly is a worm gear assembly having a base gear and a worm gear, whereby rotation of the shaft 76 increases or decreases the pre-loading of the spring 64. The increase or decrease of the shaft 76 results in an increase or decrease of the pre-load of the spring 64 which corresponds to an increase or decrease, respectively, of the speed of the pitched baseball 32.

Figure 11:
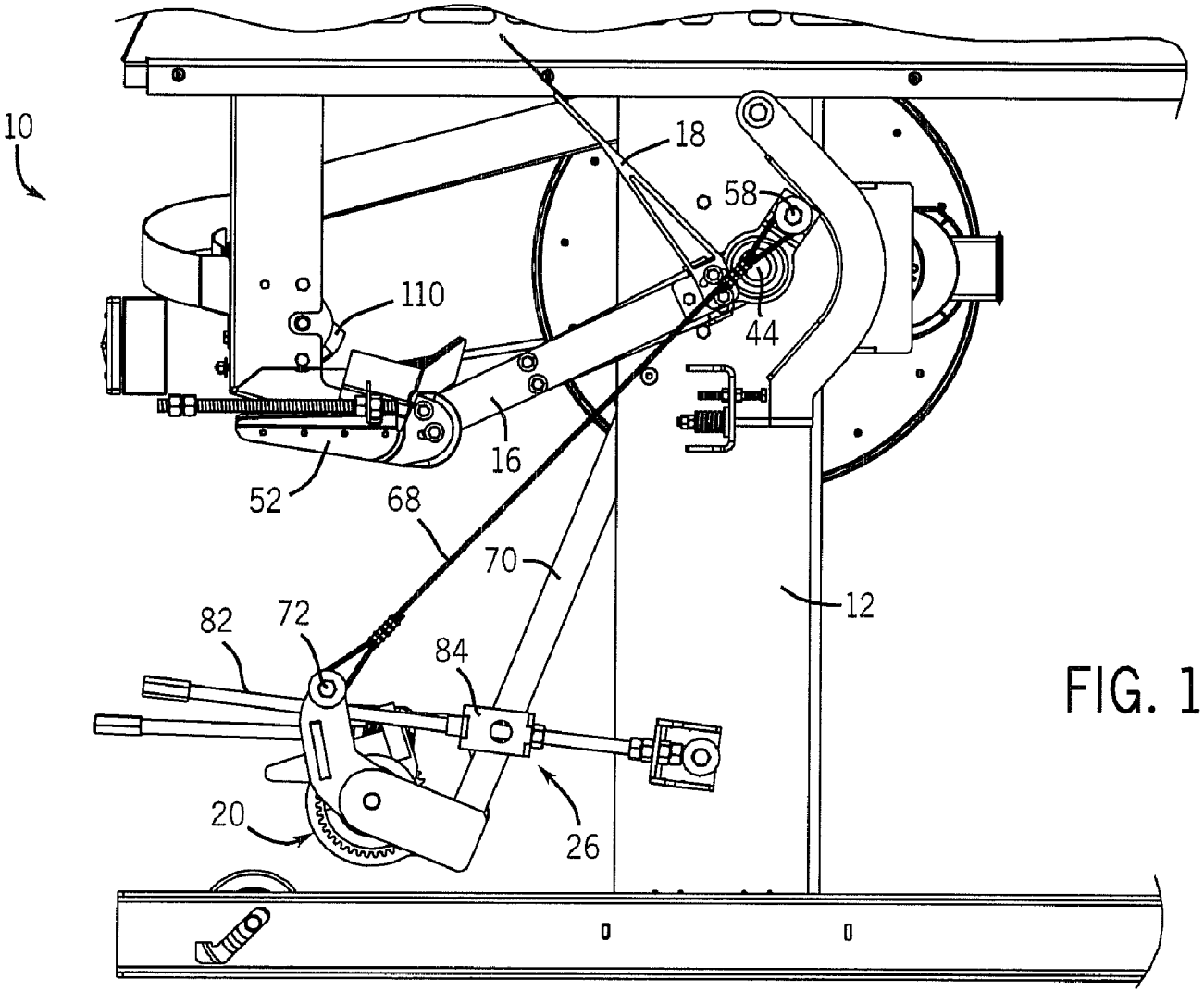
FIG. 11 is side view of the arm pitching machine of FIG. 1 showing the pitch height adjustment mechanism in a first position.
Figure 12:
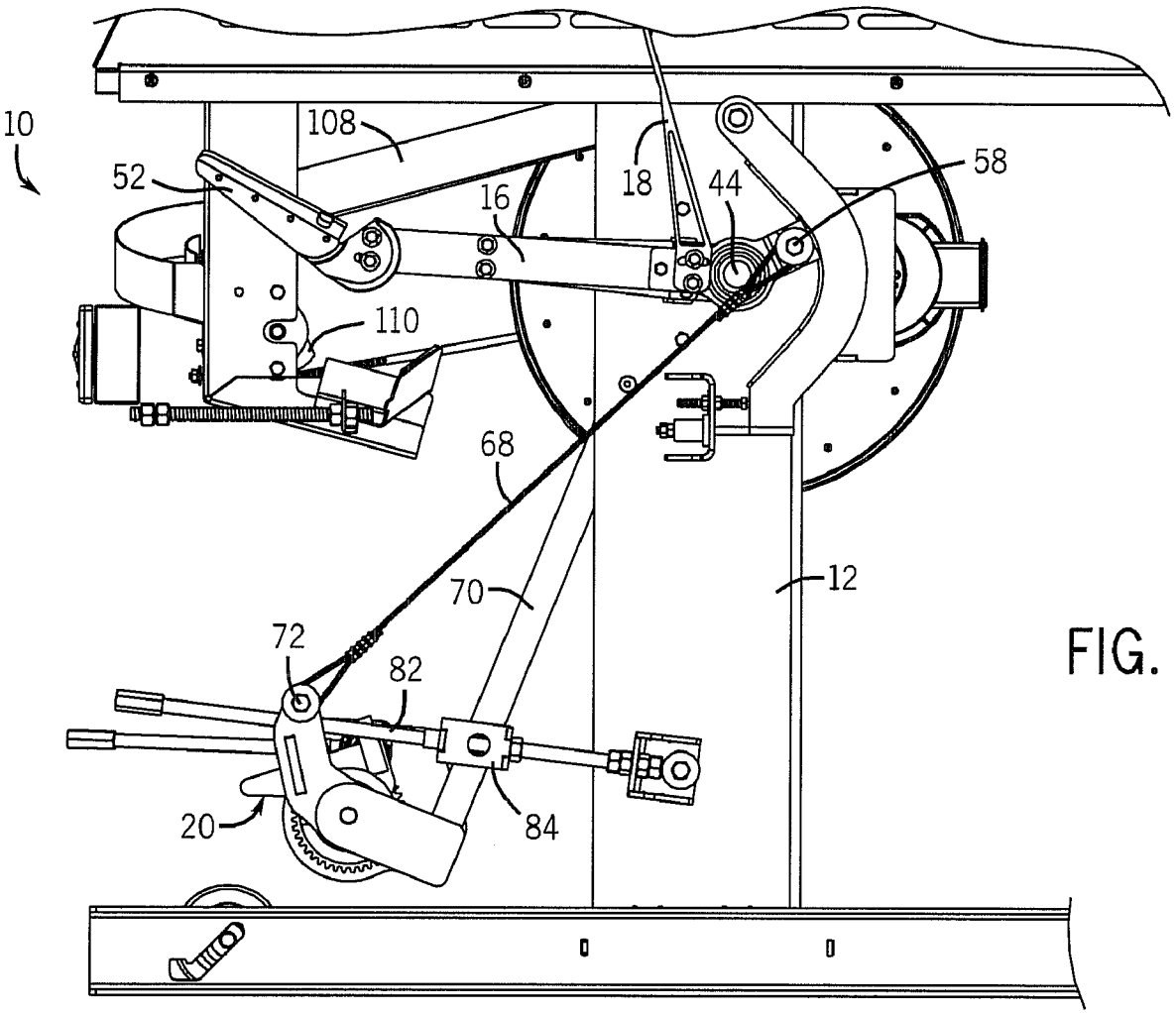
FIG. 12 is side view of the arm pitching machine of FIG. 1 showing the pitch height adjustment mechanism in a second position.

Referring to FIGS. 2, 11 and 12, the height adjustment mechanism 26 is coupled to and supported by the frame 10 and is coupled to the carriage frame 70. The height adjustment mechanism 26 includes an elevation shaft 82 and an elevation carriage 84. The elevation shaft 82 extends from the frame 12 through the elevation carriage 84 to an aperture 86 within the rear side of the housing 28 of the pitching machine 10 for access and adjustment by the operator. As the operator manipulates or adjusts the elevation shaft 82, the elevation carriage 84 extends along the axial length of the elevation shaft. The elevation carriage 84 is coupled to the carriage frame 70 such that movement of the elevation carriage 84 causes pivotal movement of the carriage frame 70 with respect to the frame 12. As the elevation carriage 84 moves fore and aft, the carriage frame 70 pivots and the height of the biasing assembly 20 and the spring 64 changes. The higher the elevation of the biasing assembly 20, the later the release point of the baseball from the pitching arm 16 and the lower the pitch, and the lower the elevation of the biasing assembly 20 the sooner the release point of the baseball from the pitching arm 16 and the higher the pitch to the batter.

FIG. 11 shows the height adjustment mechanism 26 in a first position in which the elevation carriage 84 is close to the frame 12 and the biasing assembly 20 is at a low position. The low position results in a higher pitch from the pitching machine 10. FIG. 12 shows the height adjustment mechanism 26 in a second position in which the elevation carriage 84 is positioned further from the frame 12 and therefore the biasing assembly 20 is elevated. This second position results in a pitched ball having a lower elevation. The over the top location of the pitch cycle is defined by the alignment of the first and second connection points 58 and 74 with the pivot axis 44. In FIGS. 11 and 12, the change in the over the top position can be seen. In FIG. 11, since the pitching arm 16 moves in a clockwise manner from the perspective of the viewer during the pitch cycle, the over the top position occurs sooner resulting in an earlier release of the ball from the pitching machine 10 and a higher pitch. In FIG. 12, the over the top position occurs later in the pitch cycle resulting in a later release of the ball from the pitching machine and a lower pitch. A batter or operator of the pitching machine 10 can adjust the pitching machine to other height positions beyond the first and second positions of FIGS. 11 and 12.

Referring to FIGS. 1 and 4-6, the ball feed system 22 is illustrated. The ball feed system 22 is configured to retain a plurality of baseballs and to feed or supply the baseballs to a ball acquisition structure 100 of the pitching machine 10. The feed system 22 includes a hopper 102, a feeder dish 104, a ball catch 106, a feed trough 108, a ball cup 110, a ball cup linkage 112 and the ball acquisition structure 100. Referring to FIG. 4, the hopper 102 is a ball storage structure configured for retaining a plurality of the baseballs 32. The hopper 102 includes an enlarged opening 104 for loading the baseballs 32 into the hopper 102. The hopper 102 can be sized to retain different quantities of baseballs, such as, for examples, 25 balls, 50 balls, 100 balls, etc. The hopper 102 includes sidewalls 114 and sloped lower surfaces 116 to direct the balls 32 to the feed dish 104. The hopper 102 is advantageously positioned at the top of the pitching machine 10 to allow for a gravity feed of the baseballs 32. In an alternative preferred embodiment, the hopper 102 can be removed and a remote feed trough or remote ball storage assembly can be coupled to the pitching machine 10 to supply the balls to the pitching machine.

The feeder dish 104 is positioned at the bottom of the hopper 102 and is operably coupled to the drive wheel 42. Rotation of the drive wheel 42 caused by rotation of the drive shaft 38 causes the feeder dish 104 to rotate. In a preferred embodiment, the feeder dish 104 includes a plurality of fins 118 to agitate the balls 32 and facilitate the efficient movement of the balls to the feed trough 108. The ball catch 106 is coupled to the hopper 102 for facilitating the collection of the balls into the feed trough 108. As the feeder dish 104 rotates, the balls 32 at the bottom of the hopper 102 are directed toward the ball catch 106, which assists in directing the balls toward the central opening 120 in the hopper 102 to the feed trough 108.

The feed trough 108 is a sloped passageway and structure for routing the baseballs 32 that enter the feed trough 108 through the central opening 120 to the ball cup 110. The feed trough 108 is sized and shaped to arrange the balls 32 in a consecutive order or line, such that no one ball 32 can overtake or pass up another ball 32 in the feed trough 108. The feed trough 108 is sloped and routed to direct the balls 32 in an efficient manner to the ball cup 110 using gravity. The feed trough 108 also serves as a storage location for some of the plurality of balls.

The ball cup 110 is coupled to the ball cup linkage 112 and supported by the frame 12. The ball cup 110 is sized for retaining a single baseball 32 or softball. The ball cup 110 includes a curved wall 122 defining a ball opening 124 sized for receiving and dispensing the single ball 32.

The hopper 102, the feeder dish 104, the ball catch 106, the feed trough 108 and the ball cup 100 can be formed from a number different materials, such as, for example, steel, other alloys, a fiber composite material, a plastic, wood, a thermoset material and combinations thereof. The ball cup linkage 112 uses the rotation of the drive shaft 38 to induce rotation of the ball cup 110 about a second pivot axis 126. The linkage 112 is connected at one end to the drive shaft 38 and at the other to the ball cup 110. The ball cup 110 thereby rotates at approximately the same speed as the drive shaft 38. Accordingly, the operation of the ball cup 110 and the pitching arm 16 are coordinated and synchronized. In an alternative preferred embodiment, the ball cup linkage 112 can be arranged to provide rotation of the ball cup 110 at another speed that is a fraction or multiple of the speed of the drive shaft. As the ball cup 110 rotates about the second pivot axis 126, the opening 124 presents itself or is moved next to the lowest ball in the feed trough 108. Gravity causes the lowest ball to enter the ball cup 110 and the size of the ball cup prevents more than one ball from entering the ball cup 110 when the ball cup opening 124 is present at the balls of the feed trough. As the ball cup 110 continues to rotate, the curved wall 122 of the ball cup 110 bears against the one or more balls remaining in the feed trough 108 and prevents the balls from moving into the ball cup 110 or traveling elsewhere. As the ball cup 100 further continues to rotate, the opening 124 presents itself toward the ball acquisition structure 100 and when the opening 124 moves just below the ball 32 within the ball cup 110, the ball 32 exits the ball cup 110 and drops to the ball acquisition structure 100. As the ball cup 110 continues to rotate, the cycle repeats itself and eventually the ball cup opening 124 appears next to the next lowest ball in feed trough enabling it to enter the ball cup.

The ball acquisition structure 100 is configured for receiving the single ball 32 from the ball cup 110 and directing the ball 32 to a ball pick-up location 140. The ball acquisition structure 100 includes a drop tray 142 having a lower edge 144 and a side wall 146 with a side edge 148, and a ball stop 150. The drop tray 142 is positioned at an elevation below the center of the ball cup 110 such that the ball 32 dispensed from the ball cup 110 through the ball cup opening 124 drops onto the drop tray 142. The drop tray 142 is preferably sloped to direct the ball to the ball pick-up location 140. The ball pick-up location 140 is defined by three spaced apart contact points one being the lower edge 144, the second being the side edge 148 and the third being the ball stop 150. These three points support the single ball 32 in a stable position and in a spaced apart manner such that the throwing hand 52 of the pitching arm 16 can travel upward through the space provided between the ball stop 150 and the edges 144 and 148 to pick-up the ball 32. In other preferred embodiments, the ball acquisition structure 100 can take other forms and the ball pick-up location 140 can include other spaced apart support structures.

Figure 7:
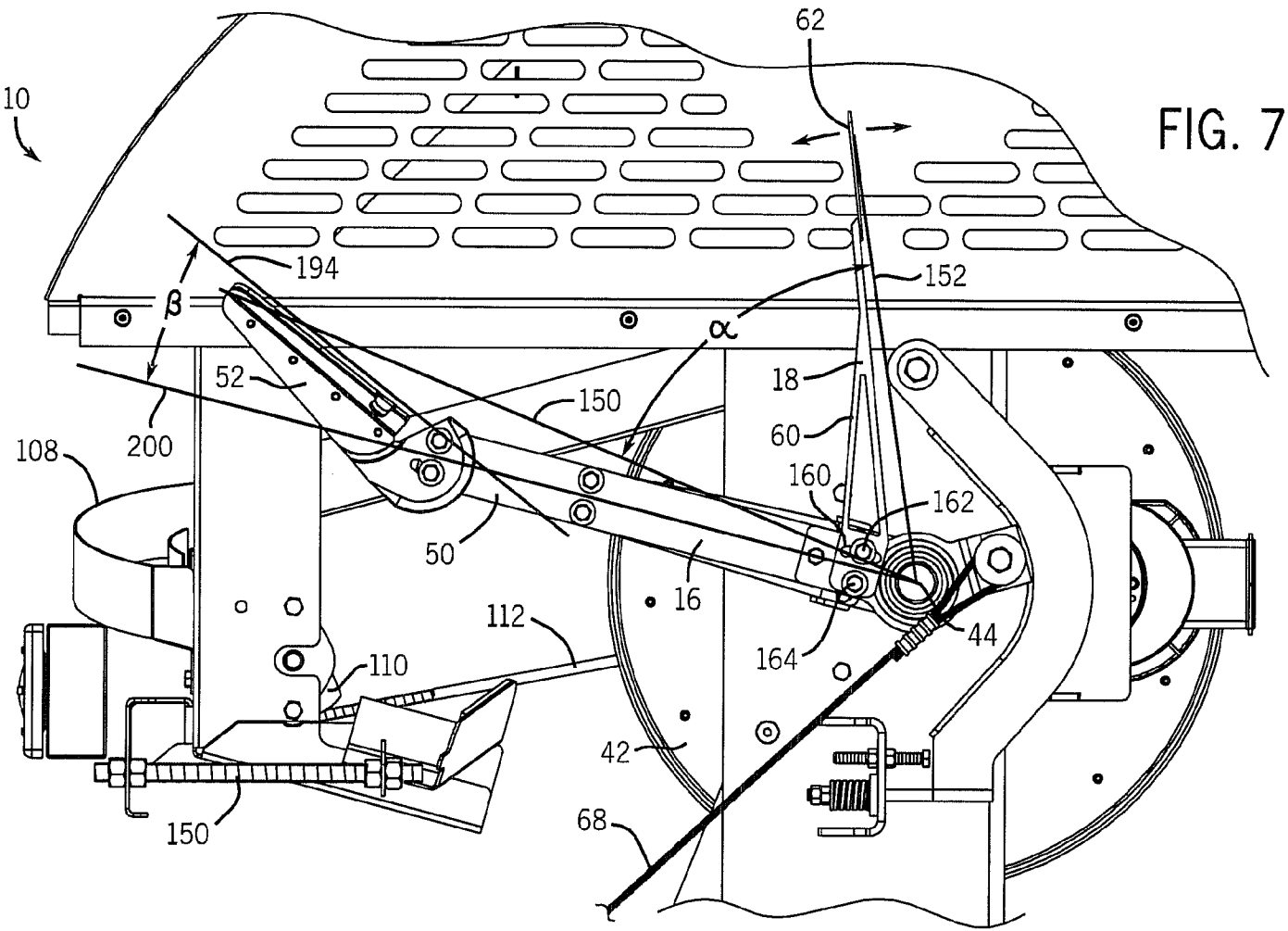
FIG. 7 is a side view of the pitching arm of the pitching machine of FIG. 1 in a different rotational position.

Referring to FIGS. 1 and 7, the lead timing arm 18 provides an indication to a batter positioned in a first batting location a first predetermined distance from the pitching machine that the pitch from the pitching arm 16 is about to occur. The predetermined distance is dependent on the particular application and batter. The predetermined distance can be selected from the range of 30 feet to 100 feet. The lead indication provided by the lead timing arm 18 enables the batter to load or otherwise prepare for the pitched ball in the same manner the batter would for a pitcher entering his or her windup. In other words, the batter visually recognizes the lead timing arm 18 prior to seeing the pitching arm 16 or the pitched baseball 32. The position of the lead timing arm 18 relative to the pitching arm 16 is adjustable to enable the batter or an operator of the machine reposition or adjust the lead timing arm 18 to the desired position ahead of the pitching arm 16. The lead timing arm 18 is adjustably coupled to the pitching arm 16. In one preferred embodiment, the lead timing arm 18 is coupled to the pitching arm 16 using fasteners. In alternative preferred embodiments, the lead timing arm 18 can be coupled to the pitching arm 16 through other means, such as, for example, a snap fit connection, a clamp or other fastening means. In a particularly preferred embodiment, the support link 60 of the lead timing arm 18 includes a curved slot 160 and a first releasable fastener 162 extends through the slot 160 to connect the lead timing arm 18 to the pitching arm 16, and a second releasable fastener 164 is spaced apart from the slot 162 and provides a pivot point for the lead timing arm 18 to be repositioned within the slot 160.

Accordingly, the lead timing arm 18 is normally secured to the pitching arm 16 through the first and second releasable fasteners 162 and 164. If the operator of the pitching machine 10 wishes to adjust the position of the lead timing arm 18 with respect to the pitching arm 16, the operator simply loosens the first and second releasable fasteners 162 and 164 to allow for the repositioning of the lead timing arm 18. The loosed releasable fasteners 162 and 164 enable the lead timing arm 18 to be easily readjusted by moving the lead timing arm such that the first releasable fastener 162 moves along the slot 160. When the new desired position is obtained, the operator retightens the first and second releasable fasteners 162 and 164 to complete the adjustment. The size of the support link 60 and the slot 160 can be varied to produce a larger or smaller angular adjustment range for the lead timing arm 18 with respect to the position of the pitching arm 16.

The radial distance from the first pivot axis 44 to a first distal end of the throwing hand 52 defines a first line segment 150 (or line), and the radial distance from the first pivot axis 44 to a second distal end of the marker 62 of the lead timing arm 18 defines a second line segment 152 (or line). The angle formed between the first and second line segments 150 and 152 is a lead angle $\alpha$. In one preferred embodiment, the lead angle $\alpha$ is within the range of 10 to 120 degrees. In a more preferred embodiment, the lead angle $\alpha$ is within the range of 30 to 90 degrees, and in another preferred embodiment of the present invention, the lead angle $\alpha$ is within the range of 50 to 70 degrees.

The marker 62 is configured to be visible to the batter. The marker 62 preferably has a planar front surface and has a rectangular shape. In alternative preferred embodiments, the marker including the front surface can be spherical, hemispherical, concave, convex, a three-dimensional polygonal shape, cylindrical, semi-cylindrical, irregular or any combination thereof. Further, the marker 62 is preferably given a first color that is different from the color or colors of the other components of the pitching machine 10 including the pitching arm 16, the housing 28, etc. In other preferred embodiments, the front surface of the marker 62 can include a combination of two or more colors or a graphic image, such as, a target, a logo, a trademark, an image of a professional baseball pitcher, a notorious person, etc.

Figure 8:
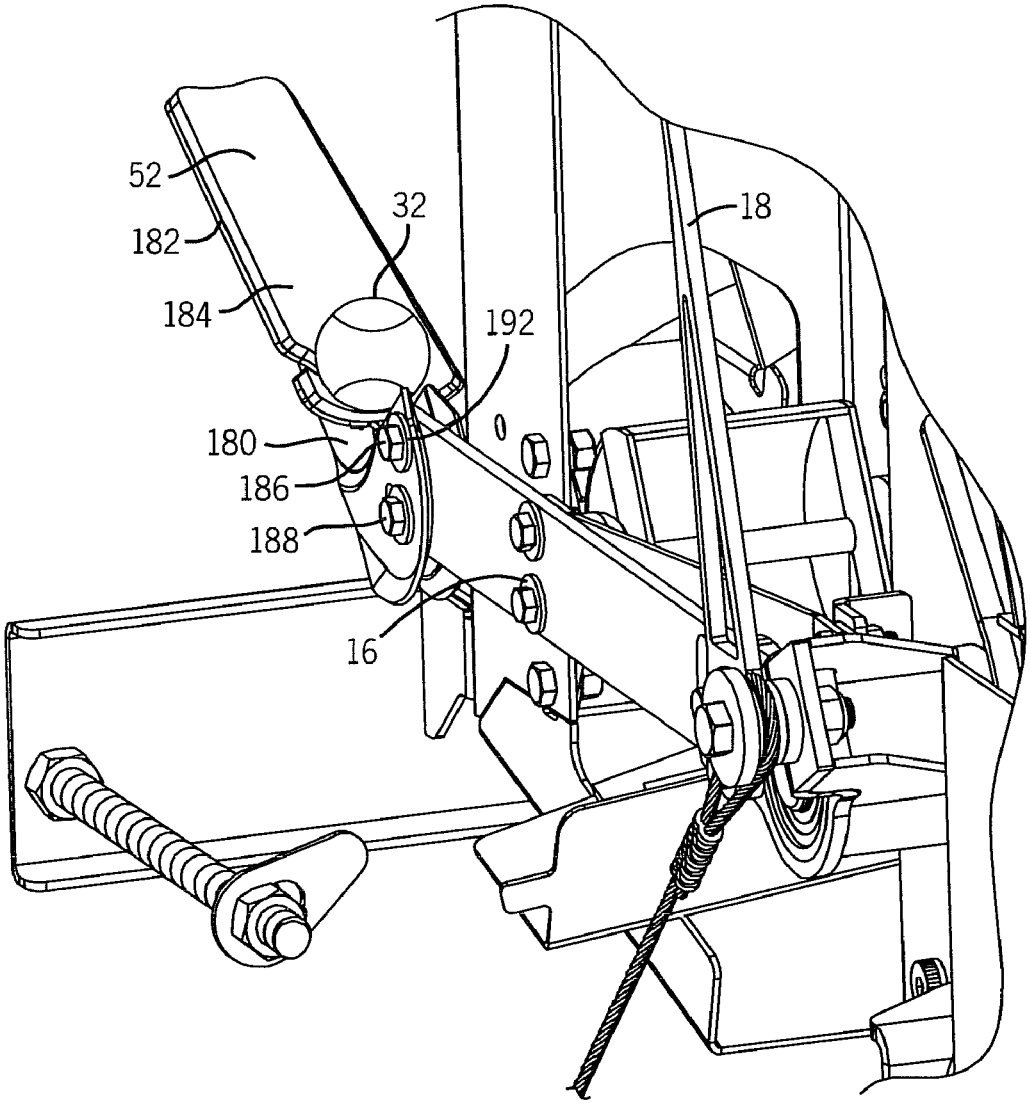
FIG. 8 is a front, side perspective view of the pitching arm of the pitching machine of FIG. 7
Figure 9:
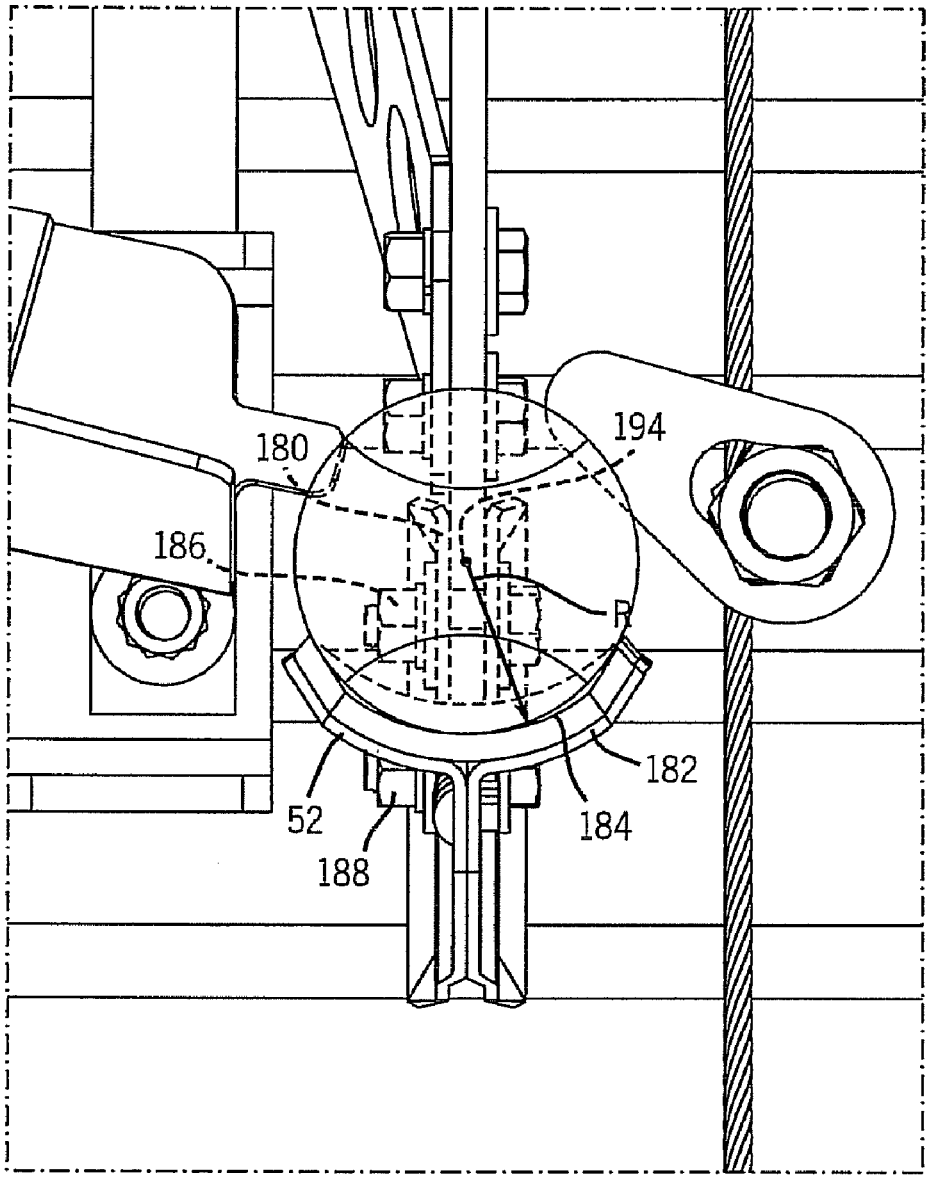
FIG. 9 is an end view of a throwing hand of the pitching arm of the pitching machine of FIG. 7.
Figure 10:
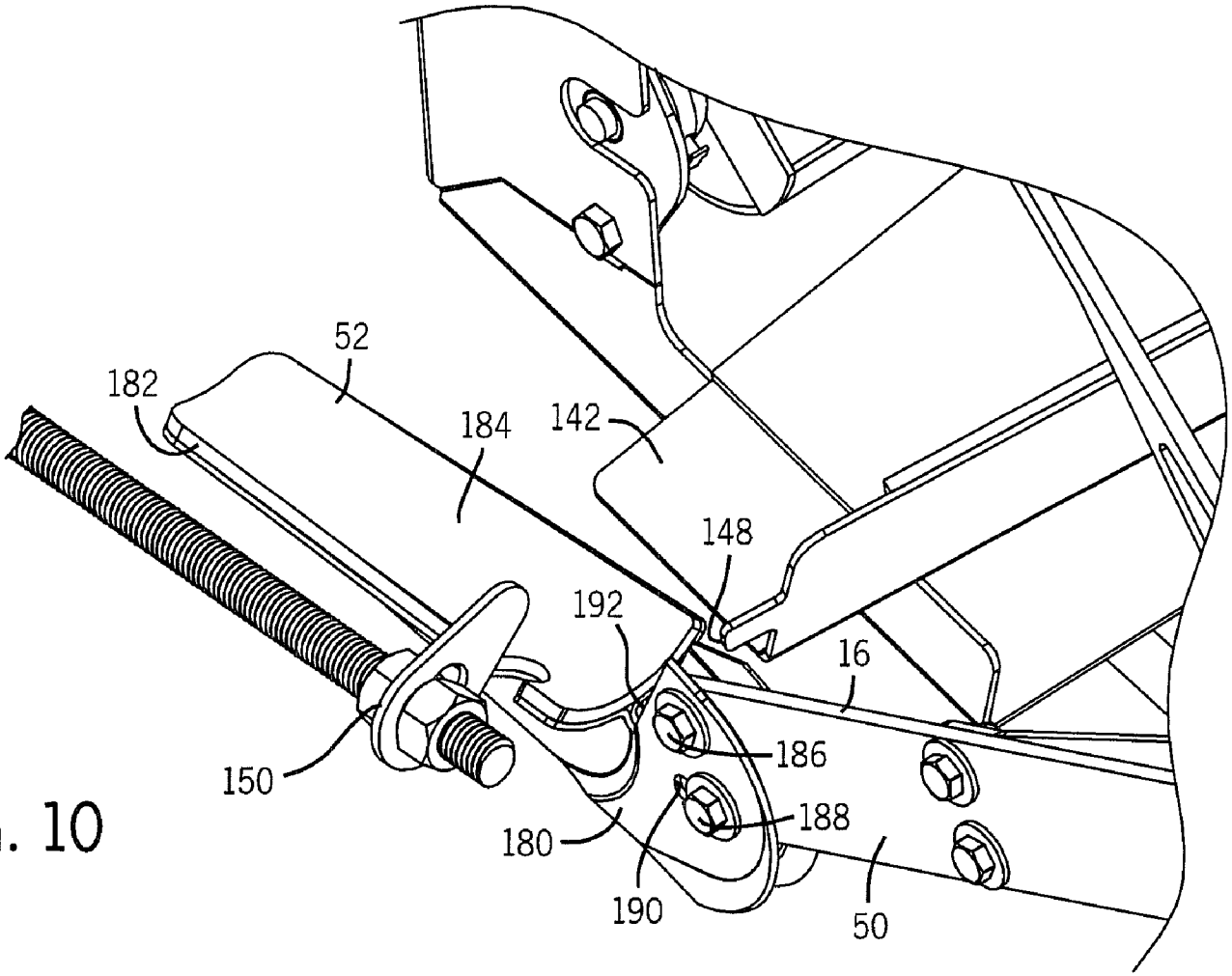
FIG. 10 is a top, side view of the ball acquisition structure and the throwing hand of the pitching arm of FIG. 1.

Referring to FIGS. 7 through 9, the throwing hand 52 is shown in greater detail. The throwing hand 52 includes a base 180, a ball platform 182 and a ball contact pad 184 applied to the ball side of the ball platform 182. The base 180 of the throwing hand 52 is connected to the arm link 50, preferably through first and second fasteners 186 and 188. The base 180 includes an adjustment slot 190 for selectable adjustment of the angle of the throwing hand 52 with respect to the arm link 50. The base 180 also provides a ball rest point 192. The ball platform 182 is a curved elongate support structure. The ball contact pad 184 is attached to the forward surface of the ball platform 182. The ball contact pad 184 is preferably made of a resilient material preferably a rubber. In alternative preferred embodiments, the ball contact pad 184 can be formed of other materials such as, for example, other elastomeric materials, a plastic, wood, a foam layer and combinations thereof.

The ball platform 182 and the ball contact pad 184 define a ball contact region that is shaped as a portion of a cylinder. The ball contact region is linear about a throwing hand longitudinal axis 194 and curved radially about the longitudinal axis 194. The radius R is equal to or greater than the radius of the ball 32 and the length of the ball platform 182 and ball contact pad 184 defining the ball contact region is at least twice as long as the diameter of the ball 32. In one preferred embodiment, the R is at least 1.43 inches long and the length is at least 5.72 inches long. In other alternative preferred embodiments, larger radius values can be used and the length of the ball contact region can be at least 2.5 times, 3 times, 3.5 times, or 4 times the diameter of the ball. The selection of a curvature of the ball contact region that has a diameter at least as great as the radius of the ball enables more contact between the ball and the ball contact pad 184 as the ball 32 is pitched from the pitching arm 16. The curvature of the ball contact region preferably extends over at least 60 degrees of the circumference of the ball 32. In other preferred embodiments, the ball contact region can extend over at least 80 degrees of the circumference of the ball. This increased contact provides for greater repeatability and accuracy of the pitched ball from the pitching machine 10.

The arm link 150 is preferably a linear support that extends about an arm link axis 200. The angle, β, formed by the throwing hand longitudinal axis 194 and the arm link axis 200 is adjustable through adjustment of the fasteners 186 and 188 through the slot 190. In a preferred embodiment, the angle β is adjustable within the range of 0 to 40 degrees. In another alternative preferred embodiment, the angle β is adjustable within the range of 15 to 30 degrees. The ball platform 182 and ball contact pad 184 further define a cutout 198 sized to receive a portion of the ball stop 150 thereby allowing the throwing hand 52 to come directly under the ball 32 as it is retrieved or picked-up by the pitching arm 16 in the pitch cycle.

Referring to FIGS. 2, 3 and 13-19, the motion of the pitching arm 16 and the lead timing arm 18 are shown through different positions of the pitch cycle. In FIGS. 2-3, the pitching arm 16 is in a first position wherein the ball 32 has just been pitched from the pitching machine 10. Referring to FIG. 3, the batter can see the ball 32 and the throwing hand 52 of the pitching arm 16 through the ball delivery window 30.

Figure 13:
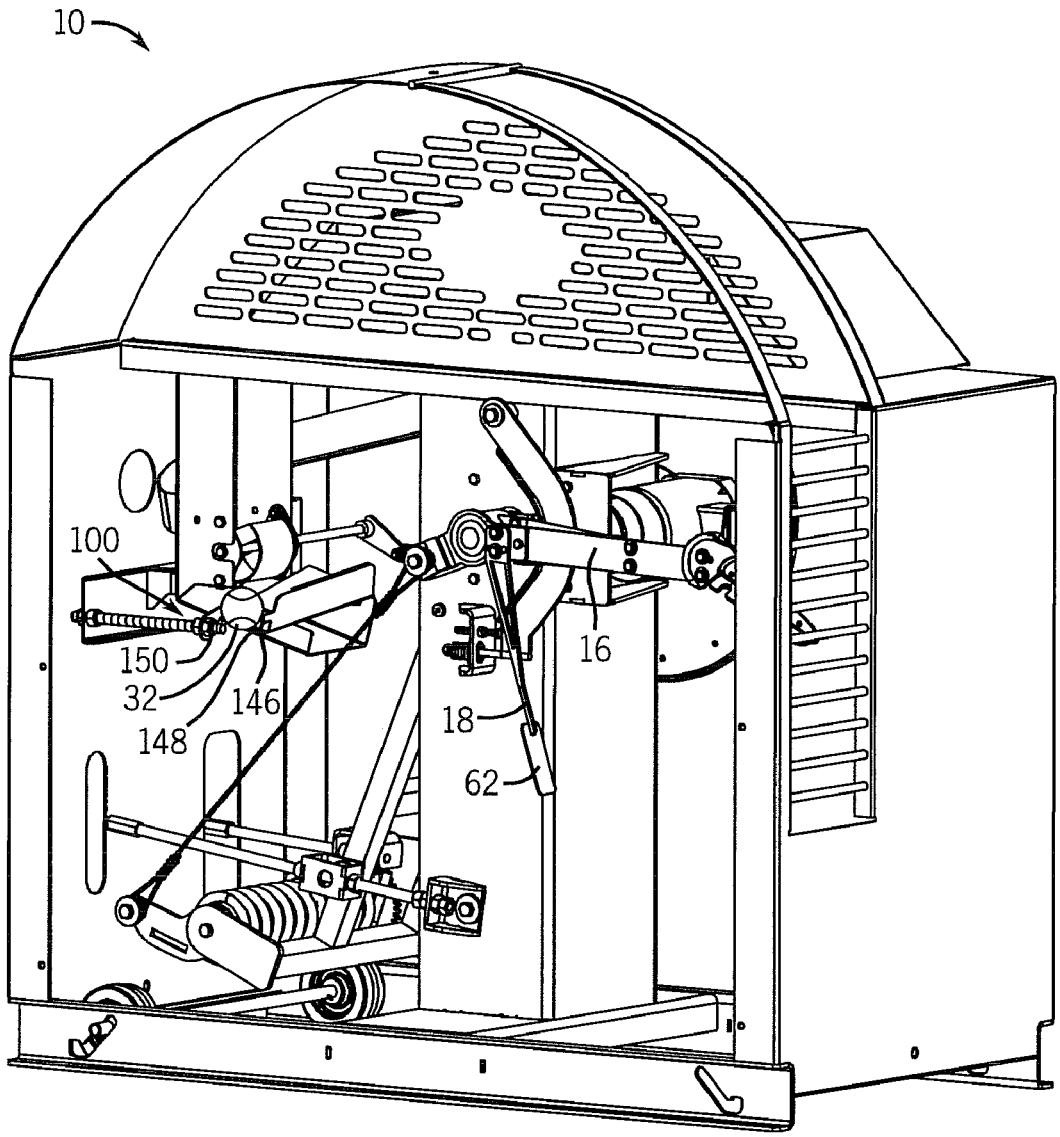
FIG. 13 is a front, side perspective view of the pitching machine of FIG. 1 with the pitching arm in a second position.
Figure 14:
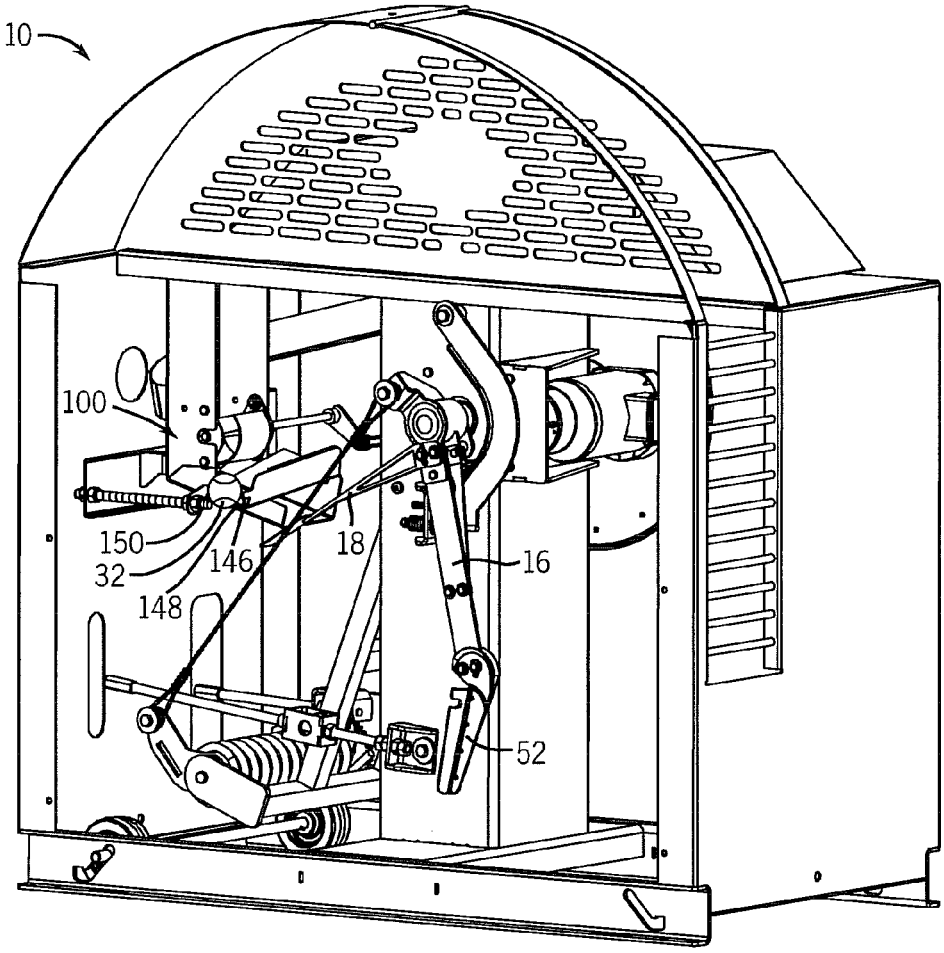
FIG. 14 is a front, side perspective view of the pitching machine of FIG. 1 with the pitching arm in a third position.
Figure 15:
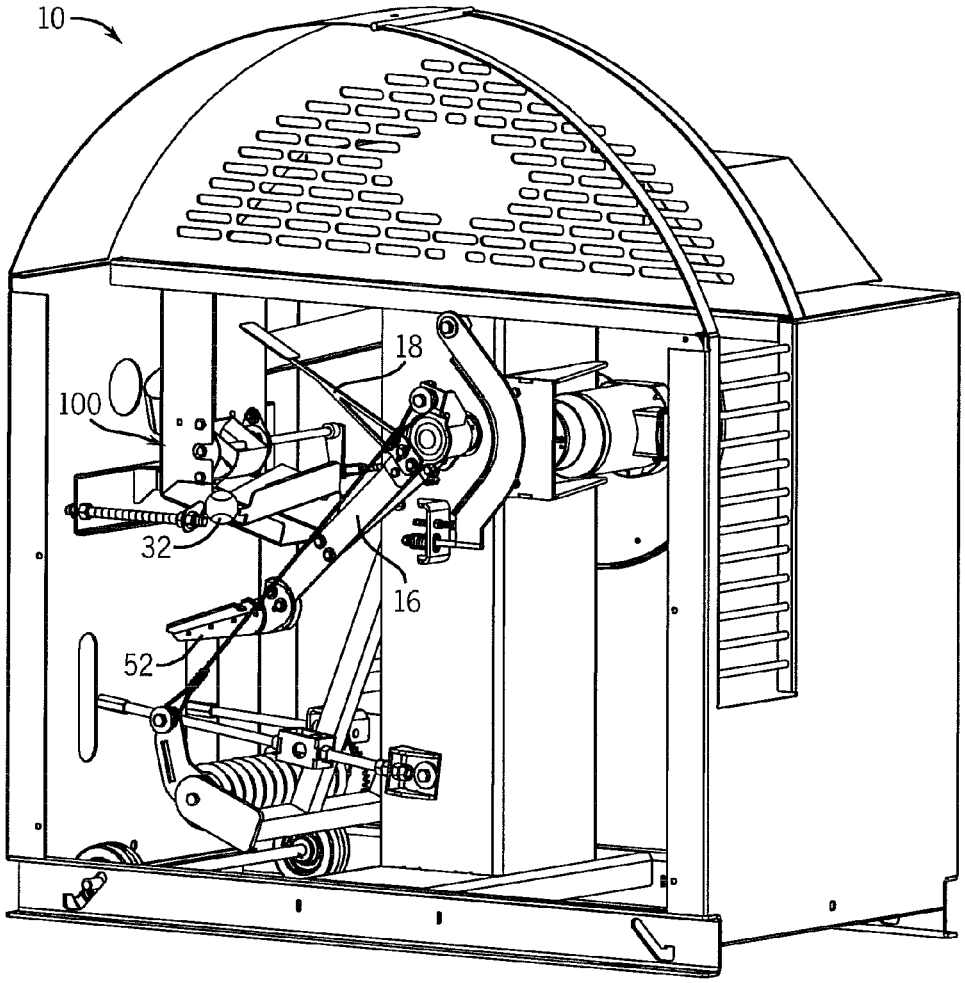
FIG. 15 is a front, side perspective view of the pitching machine of FIG. 1 with the pitching arm in a fourth position.

Referring to FIGS. 13 through 15, the pitching arm 16 is shown in second, third and fourth positions as it travels in a clockwise manner through the pitch cycle. The ball 32 is being supported by the lower edge 144, the side edge 148, and the ball stop 150 of the ball acquisition structure 100. The pitching arm 16 moves in a clockwise manner (from the perspective of the FIGS.) and is driven by the drive shaft 38 and the drive collar 40 as it approaches the ball pick-up position.

Figure 16:
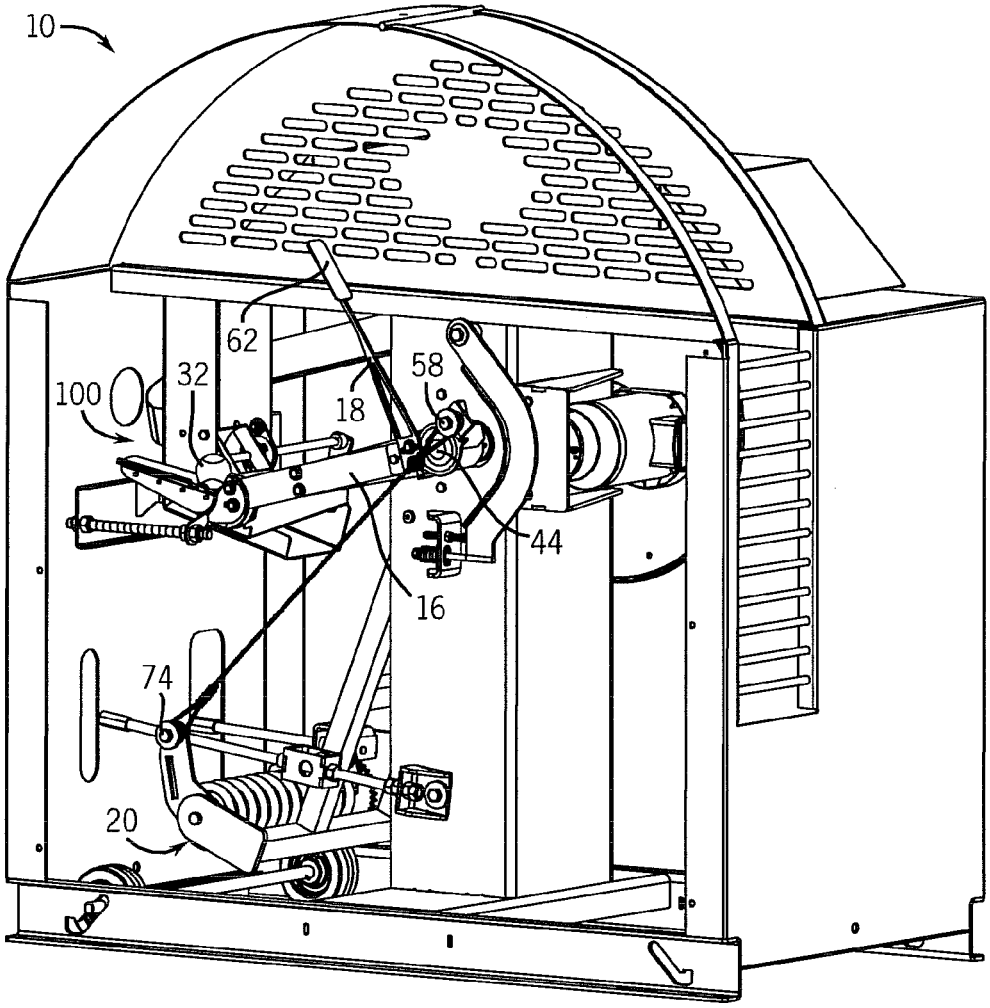
FIG. 16 is a front, side perspective view of the pitching machine of FIG. 1 with the pitching arm in a fifth position.
Figure 17:
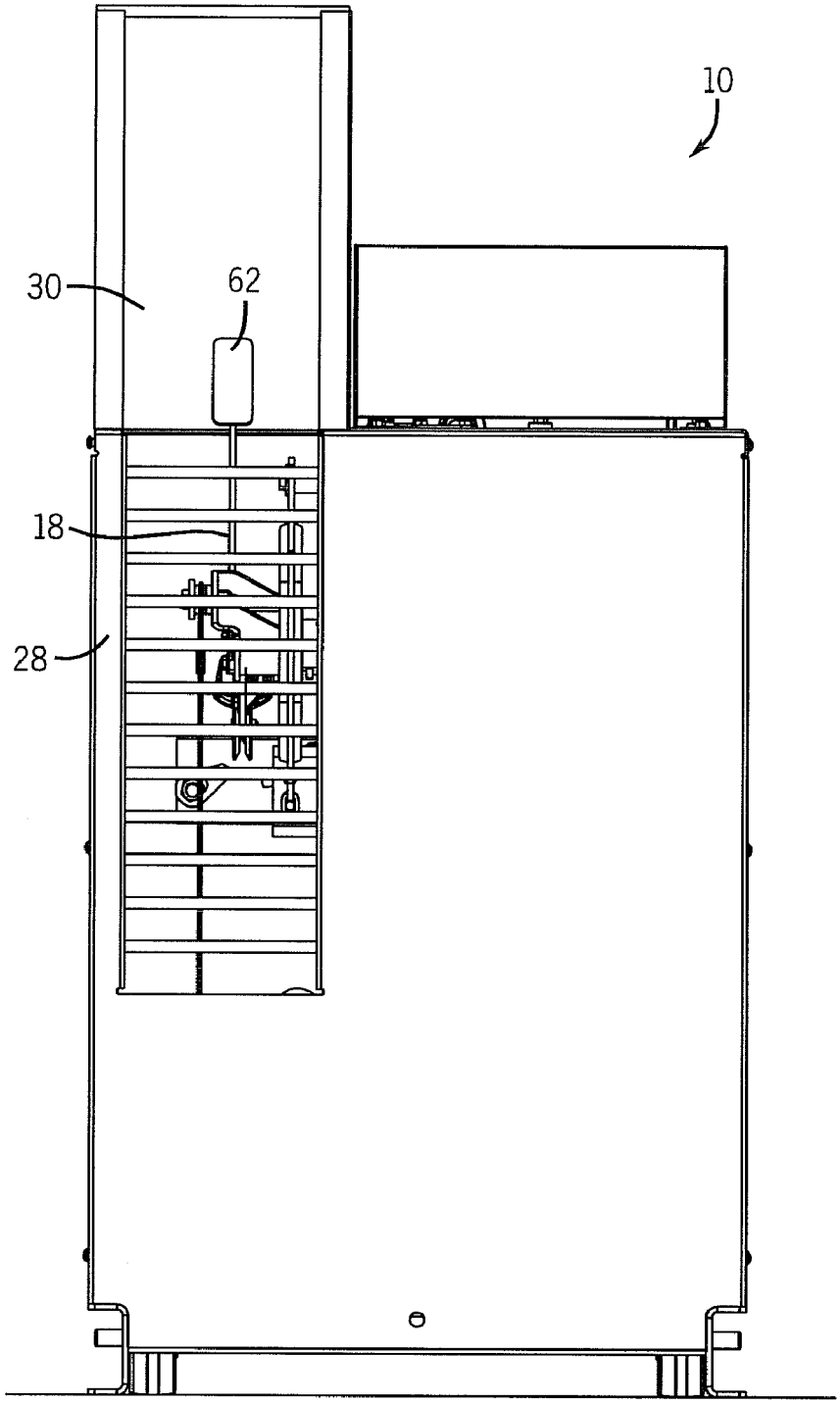
FIG. 17 is a front view of the pitching machine of FIG. 16.

Referring to FIGS. 16 and 17, the throwing hand 52 of the pitching arm 16 has just pick-up the ball 32 from the ball acquisition structure 100. The first and second connection points 58 and 74 are aligned with the pivot axis 44 defining the top position. As the pitching arm 16 continues to move clockwise, the connection points 58 and 72 will become out of alignment with the pivot axis 44 and this over the top position is when the biasing assembly 20 can release its stored energy and rapidly rotate the pitching arm through the next portion of the pitch cycle. The marker 62 of the lead timing arm 18 is just visible to the batter providing the batter with the early indication that a pitch is about to occur.

Figure 18:
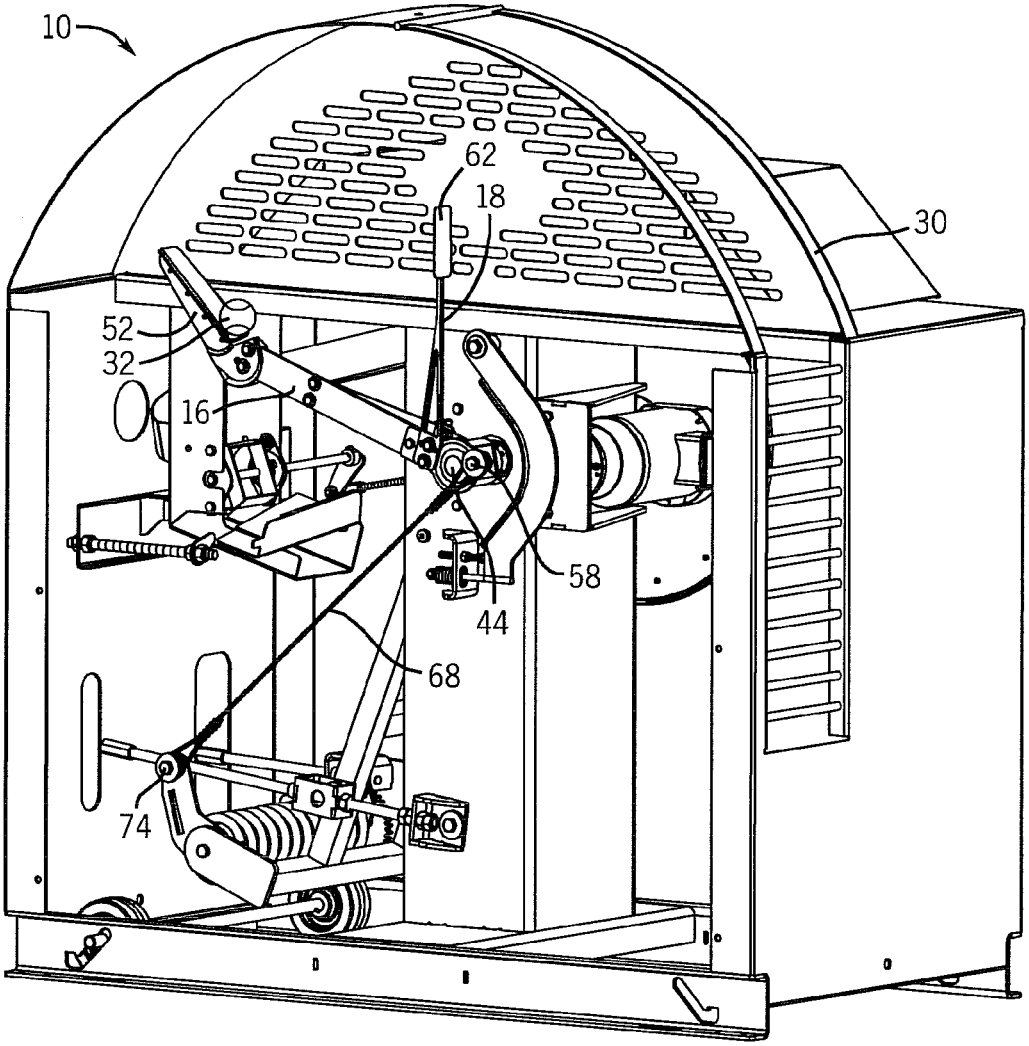
FIG. 18 is a front, side perspective view of the pitching machine of FIG. 1 with the pitching arm in a sixth position.
Figure 19:
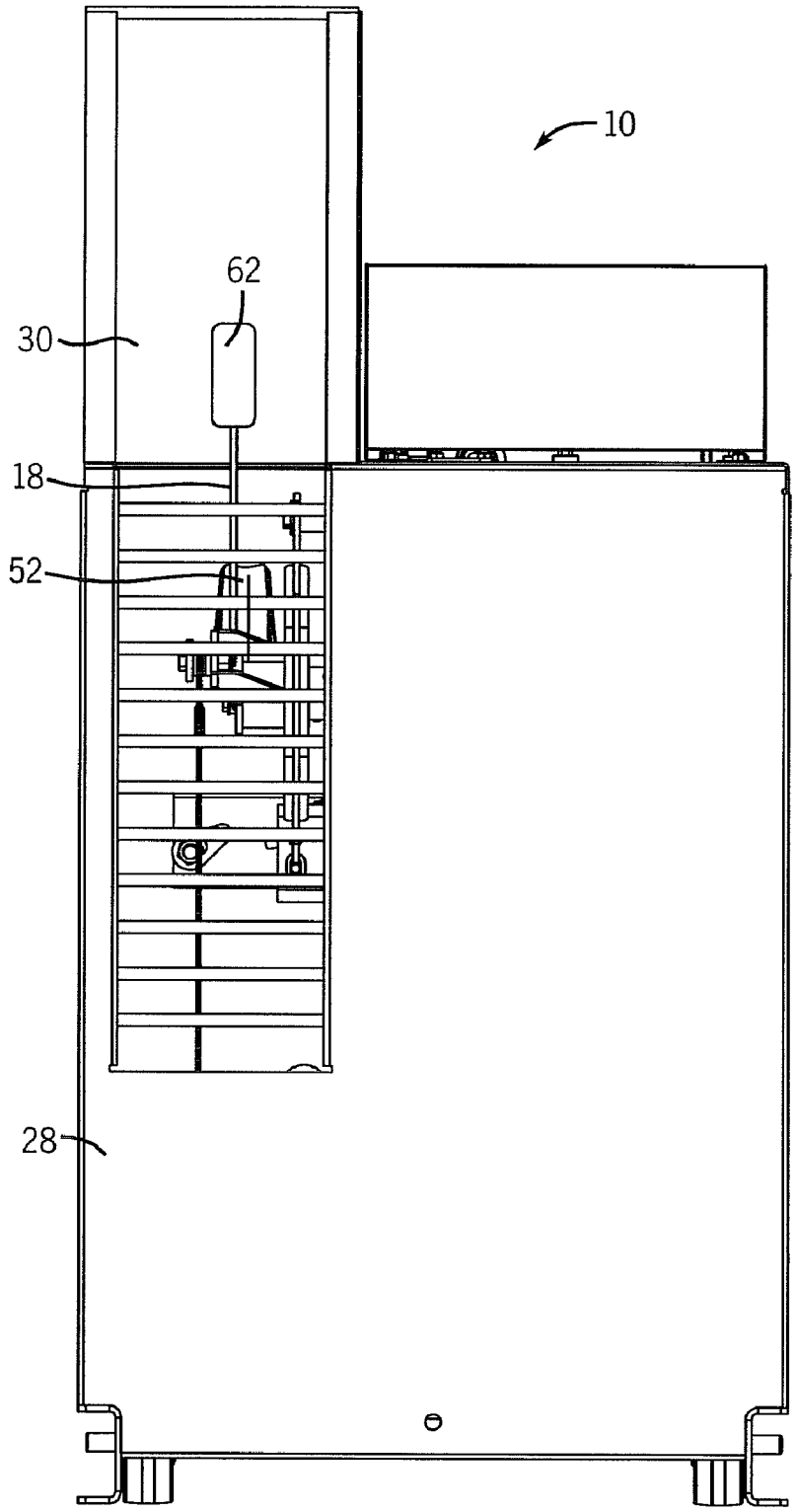
FIG. 19 is a front view of the arm pitching machine of FIG. 18.

Referring to FIGS. 18 and 19, the pitching arm 16 has just started to pitch the ball 32. The connection points 58 and 74 are no longer aligned with the pivot axis 44, so the biasing assembly 20 has released its energy to the pitching arm 16 through the cable 68 and the connection points 58 and 74. The lead timing arm 18 is in an approximate vertical position with the marker 62 in full view to the batter. The batter now can view the marker 62 and recognize that the pitching machine 10 is about to pitch the ball 32. During this portion of the pitch cycle, the pitching arm 16 is no longer driven by the drive shaft 38 and the drive collar 40. Rather, the biasing assembly drives the pitching arm 16 rapidly through the top portion of the pitch cycle to pitch the ball 32 to the batter. Upon viewing the marker 62, the batter can properly load or prepare to receive the pitched ball.

The pitching machine 10 of the present invention provides an easy, effective and repeatable way of providing an indication of when the pitch is about to leave the pitching machine 10 to the batter. The arm pitching machine 10 of the present invention provides a signal to the batter, via the marker 62 of the lead timing arm 18, that can be used by the batter to simulate the approximate time frame of a pitcher's windup. The pitching machine 10 allows a batter to readily time the pitched ball from the pitching machine 10. The arm pitching machine 10 includes a pitching arm 16 with a throwing hand 52 that provides improved contact with the ball and maximizes the accuracy of the pitched ball. The construction of the pitching arm 16 and throwing hand 52 provides repeatable accurate pitches in the location desired by the batter or person (coach or manager) operating the pitching machine 10. The present invention provides an arm pitching machine 10 that allows for the speed and height of the pitched ball to be readily adjusted. The present invention also provides an arm pitching machine that pitches multiple balls one at a time and has a feed system that eliminates the side load or force on the lowest ball from the group of balls next in line for pitching.

While the preferred embodiments of the invention have been illustrated and described, it will be appreciated that various changes can be made therein without departing from the spirit and scope of the invention. For example, while the embodiments described herein are illustrated in a pitching machine for pitching baseballs, the principles of the present invention could also be used for pitching machines for pitching practically any other type of ball. Accordingly, it will be intended to include all such alternatives, modifications and variations set forth within the spirit and scope of the appended claims.

What is claimed is:

1. A pitching machine for pitching a ball to a batter positioned in a first batting location a first predetermined distance from the pitching machine, the pitching machine comprising:

a frame;

a drive assembly coupled to the frame;

a pitching arm coupled to drive assembly and rotatable in a first direction about a first axis, the pitching arm including a forward side configured to contact and project the ball during a portion of the rotation of the pitching arm about the first axis, the pitching arm configured to project the ball at at least a first ball release position with respect to the first axis; and a lead timing arm including a marker, the lead timing arm coupled to the pitching arm such that the marker is visible to the batter positioned in the first batting location prior to the pitching arm reaching the first ball release position, the marker configured to move in a path of motion having at least first and second positions, the first position being rearward of a vertical plane extending through the first axis and orthogonal to the first direction, and the second position being forward of the vertical plane.

2. The pitching machine of claim 1, further comprising a biasing assembly coupled to the pitching arm and to the frame, the biasing assembly configured to accelerate the rotation of the pitching arm about the first axis to enable the pitching arm to project the ball.

3. The pitching machine of claim 1, wherein the lead timing arm is attached to the pitching arm, and wherein the lead timing arm is configured to move with the pitching arm as the pitching arm rotates about the first axis.

4. The pitching machine of claim 1, wherein the lead timing arm is adjustably coupled to the pitching arm thereby enabling the lead timing arm to be selectably positioned with respect to the pitching arm in at least first and second operating positions.

5. The pitching machine of claim 4, wherein in the first operating position, the marker of the lead timing arm is positioned a first distance from the pitching arm, wherein in the second operating position, the marker of the lead timing arm is positioned a second distance from the pitching arm, and wherein the second distance is greater than the first distance.

6. The pitching machine of claim 4, wherein in the first operating position, the marker of the lead timing arm is positioned a first angular position from the pitching arm, wherein in the second operating position, the marker of the lead timing arm is positioned a second angular position from the pitching arm, and wherein the second angular position is greater than the first angular position.

7. The pitching machine of claim 1, wherein the shape of the marker is selected from the group consisting of planar, spherical, hemispherical, concave, convex, three dimensional polygonal shaped, cylindrical, semi-cylindrical and combinations thereof.

8. The pitching machine of claim 1, wherein the marker is formed of a color that is different from the color or colors of the pitching arm.

9. The pitching machine of claim 1, wherein the pitching arm has a distal region and a proximal region, and wherein the pitching arm includes a throwing hand coupled to the distal region of the pitching arm.

10. The pitching machine of claim 9, further comprising a housing assembly coupled to the frame, and wherein the housing assembly defines a ball exit opening.

11. The pitching machine of claim 10, wherein the ball exit opening is sufficiently sized to enable the batter in the batting location during operation of the pitching machine to see the lead timing arm followed by the throwing hand.

12. A pitching machine for pitching a ball, the pitching machine comprising:

a frame;

a drive assembly coupled to the frame;

a pitching arm coupled to drive assembly and including a throwing hand having a first distal end, the pitching arm being rotatable in a first direction about a pivot axis, the radial distance from the pivot axis to the first distal end defining a first line segment; and a lead timing arm including a marker and having a second distal end, the lead timing arm coupled to the pitching arm and configured to move with the pitching arm, the radial distance from the pivot axis to the second distal end defining a second line segment, the first and second line segments defining a lead angle, the lead angle being within the range of 10 to 120 degrees, the marker configured to move in a path of motion having at least first and second positions, the first position being rearward of a vertical plane extending through the pivot axis and orthogonal to the first direction, and the second position being forward of the vertical plane.

13. The pitching machine of claim 12, further comprising a biasing assembly coupled to the pitching arm and to the frame, the biasing assembly configured to accelerate the rotation of the pitching arm about the first axis to enable the pitching arm to project the ball.

14. The pitching machine of claim 12, wherein the lead angle is within the range of 30 to 90 degrees.

15. The pitching machine of claim 12, wherein the lead angle is within the range of 50 to 70 degrees.

16. The pitching machine of claim 12, wherein the lead timing arm is adjustably coupled to the pitching arm thereby enabling the lead timing arm to be selectably positioned with respect to the pitching arm in at least first and second operating positions, and wherein the first and second operating positions define first and second lead angles.

17. The pitching machine of claim 12, wherein the shape of the marker is selected from the group consisting of planar, spherical, hemispherical, concave, convex, three dimensional polygonal shaped, cylindrical, semi-cylindrical and combinations thereof.

18. The pitching machine of claim 12, wherein the marker is formed of a color that is different from the color or colors of the pitching arm.

19. The pitching machine of claim 12, further comprising a housing assembly coupled to the frame, and wherein the housing assembly defines a ball exit opening.

20. The pitching machine of claim 19, wherein the ball exit opening is sufficiently sized to enable a batter positioned in a batting location a predetermined distance from the pitching machine, during operation of the pitching machine, to see the marker of the lead timing arm followed by the throwing hand.

* * * * *